US010561294B2

(12) United States Patent
Dirschus et al.

(10) Patent No.: US 10,561,294 B2
(45) Date of Patent: Feb. 18, 2020

(54) CLEANING APPLIANCE AND METHOD FOR CLEANING ARTICLES TO BE CLEANED

(71) Applicant: MEIKO MASCHINENBAU GMBH & CO. KG, Offenburg (DE)

(72) Inventors: Juergen Dirschus, Schutterwald (DE); Engelbert Ecker, Offenburg (DE); Bruno Gaus, Offenburg (DE); Thomas Peukert, Buehl (DE)

(73) Assignee: MEIKO MASCHINENBAU GMBH & CO., KG, Offenburg (DE)

( * ) Notice: Subject to any disclaimer, the term of this patent is extended or adjusted under 35 U.S.C. 154(b) by 60 days.

(21) Appl. No.: 15/104,716

(22) PCT Filed: Dec. 18, 2014

(86) PCT No.: PCT/EP2014/078396

§ 371 (c)(1),
(2) Date: Jun. 15, 2016

(87) PCT Pub. No.: WO2015/091750

PCT Pub. Date: Jun. 25, 2015

(65) Prior Publication Data

US 2016/0309981 A1 Oct. 27, 2016

(30) Foreign Application Priority Data

Dec. 19, 2013 (DE) ..... 10 2013 226 637

(51) Int. Cl.
*A47L 15/00* (2006.01)

(52) U.S. Cl.
CPC ..... *A47L 15/0049* (2013.01); *A47L 2401/12* (2013.01); *A47L 2401/24* (2013.01); *A47L 2501/06* (2013.01); *A47L 2501/32* (2013.01)

(58) Field of Classification Search
CPC ..... A47L 15/0049; A47L 2501/20; A47L 2401/14; A47L 2401/12; A47L 2401/06
(Continued)

(56) References Cited

U.S. PATENT DOCUMENTS 3,898,638 A * 8/1975 Deane ..... G01F 1/684 340/599
2006/0081272 A1* 4/2006 Jung ..... A47L 15/0049 134/18

(Continued)

FOREIGN PATENT DOCUMENTS

CN 1763491 A 4/2006
CN 102170816 A 8/2011

(Continued)

OTHER PUBLICATIONS

English Abstract of DE 19627762 B4, retrieved from espace.net on Sep. 27, 2016.

(Continued)

*Primary Examiner* — Michael E Barr
*Assistant Examiner* — Kevin G Lee
(74) *Attorney, Agent, or Firm* — J.A. Lindeman & Co. PLLC; Jeffrey Lindeman; Aaron Raphael

(57) ABSTRACT

What is proposed is a cleaning appliance (110) for cleaning articles to be cleaned (116). The cleaning appliance (110) comprises at least one cleaning chamber (114) and at least one nozzle (123) for applying at least one cleaning fluid (118) to the articles to be cleaned (116) within the cleaning chamber (114). The cleaning appliance (110) also comprises at least one temperature sensor (168), which is arranged in at least one desired jet region (166) of the nozzle (123). The cleaning appliance (110) also comprises a control unit (157), which is designed to analyze at least one sensor signal of the temperature sensor (168) and to evaluate a jet behavior of the nozzle (123) on the basis of the sensor signal.

18 Claims, 4 Drawing Sheets

(58) Field of Classification Search
USPC ..... 134/56 D, 57 D, 58 D
See application file for complete search history.

(56) References Cited

U.S. PATENT DOCUMENTS

| | | | | |
|---|---|---|---|---|
| 2009/0183753 | A1 | 7/2009 | Maennle et al. | |
| 2009/0242005 | A1 | 10/2009 | Gaus et al. | |
| 2010/0132735 | A1 | 6/2010 | Gaus et al. | |
| 2011/0174345 | A1 | 7/2011 | Carrer et al. | |
| 2011/0277794 | A1 * | 11/2011 | King | A47L 15/0023 134/18 |
| 2012/0312341 | A1 | 12/2012 | Rieder et al. | |
| 2014/0209120 | A1 * | 7/2014 | Allen | A47L 15/4289 134/18 |

FOREIGN PATENT DOCUMENTS

| | | | | |
|---|---|---|---|---|
| DE | 19732856 | A1 * | 2/1999 | A47L 15/0049 |
| DE | 19732856 | A1 | 2/1999 | |
| DE | 102004056052 | A1 | 6/2006 | |
| DE | 102007025263 | A1 | 10/2007 | |
| DE | 102007042076 | A1 | 3/2009 | |
| DE | 19627762 | B4 | 8/2009 | |
| DE | 102008015796 | A1 | 10/2009 | |
| DE | 20122927 | U1 | 4/2010 | |
| DE | 102009003119 | A1 | 11/2010 | |
| DE | 102009044960 | A1 | 3/2011 | |
| DE | 102005033110 | B4 | 5/2011 | |
| DE | 102010051524 | A1 | 5/2012 | |
| EP | 1306045 | A1 | 5/2003 | |
| EP | 1477238 | B1 | 11/2004 | |
| EP | 1522251 | B1 | 4/2005 | |
| EP | 1647220 | A2 | 4/2006 | |
| EP | 2014312 | B1 | 1/2009 | |
| EP | 2214844 | B1 | 8/2010 | |
| EP | 2614763 | A1 | 7/2013 | |
| EP | 2614763 | B1 * | 3/2015 | A47L 15/0049 |
| WO | 2001062790 | A2 | 8/2001 | |
| WO | 2011035940 | A1 | 3/2011 | |

OTHER PUBLICATIONS

English Abstract of DE 19732856 A1, retrieved from espace.net on Sep. 27, 2016.

English Abstract of DE 20122927 U1, retrieved from espace.net on Sep. 27, 2016.

English Abstract of DE 102005033110 B4, retrieved from espace.net on Sep. 27, 2016.

English Abstract of DE 102007042076 A1, retrieved from espace.net on Sep. 27, 2016.

English Abstract of DE 102009003119 A1, retrieved from espace.net on Sep. 27, 2016.

English Abstract of EP 1306045 A1, retrieved from espace.net on Sep. 27, 2016.

Din EN ISO 15883-1, "Washer-disinfectors—Part 1: General requirements, terms and definitions and tests (ISO 15883-1:2006)," German Version EN ISO 15883-1:2009, Deutsche Norm, Sep. 2009, pp. 1-85.

NSF/ANSI 3—2010 "Commercial Warewashing Equipment," NSF International Standard/American National Standard, ANSI Standard, American National Standards Institute, Nov. 2, 2010, pp. 1-23 along with annex a and b.

English translation of International Preliminary Report on Patentability in corresponding International Application No. PCT/EP2014/078396, dated Jun. 30, 2016.

* cited by examiner

CLEANING APPLIANCE AND METHOD FOR CLEANING ARTICLES TO BE CLEANED

FIELD OF THE INVENTION

The invention relates to a cleaning appliance and a method for cleaning articles to be cleaned. The invention also relates to a use of at least one temperature sensor to evaluate a jet behavior of a nozzle. Cleaning appliances and methods of the specified type can be used for example in the field of dishwashing technology, in particular in the field of commercial dishwashing technology. The invention can thus be used in particular in commercial one-chamber dishwashers, such as batch dishwashers, or in pass-through dishwashers, such as flight-type dishwashers and/or rack conveyor dishwashers. Cleaning appliances of this type however can also be used in the field of care or hospital technology, for example for cleaning containers for receiving human excretions, such as bedpans. However, other fields of use are also conceivable in principle.

PRIOR ART

A large number of cleaning appliances, also referred to as cleaning devices, which can clean and/or disinfect articles to be cleaned are known from the prior art. The design of these cleaning appliances is heavily dependent on the different boundary conditions, such as the type of articles to be cleaned, the soiling, the throughput, or similar conditions. Reference can be made by way of example to cleaning appliances which are described for example in DE 10 2004 056 052 A1 or in DE 10 2007 025 263 A1.

Cleaning appliances of the aforementioned type usually contain at least one application device for applying at least one cleaning fluid to the articles to be cleaned. By way of example, a nozzle system, in particular a washing system having one or more nozzles, can be provided in order to apply one or more cleaning fluids, for example liquids and/or steam, to the articles to be cleaned.

Cleaning appliances generally contain a plurality of sensors for detecting one or more parameters. In conventional cleaning appliances, such as dishwashers, there is generally no monitoring of a pressure of the cleaning fluid. However, one or more pressure sensors can be provided nevertheless, for example in order to ensure the monitoring of a liquid circuit. Systems of this type are described for example in DE 19627762 B4, EP 01477238 B1, WO 2001/062790 A2, DE 20122927 U1 or EP 02014312 B1.

Furthermore, other types of sensors can be provided in principle, for example vibration transducers, for example in order to monitor a mechanical behavior of the cleaning appliance. Systems of this type are known for example from EP 02614763 A1. In addition, systems are known in which a rotation of a spray arm is detected magnetically or by electric fields. Systems of this type are described for example in DE 102005033110 B4, EP 01522251 B1, DE 101010051524 A1, EP 02214844 B1 or in DE 102009003119 A1.

DE 102009044960 A1 describes a method for detecting the rotation of at least one spray arm in a dishwasher. Here, a metering device which can be positioned inside the dishwasher and which comprises a sensor unit and a control unit is used. The sensor unit comprises at least one conductivity sensor. The conductivity sensor is arranged in the operating position of the metering device on the base of the metering device in the direction of the force of gravity, and the postionable metering device is formed and arranged inside the dishwasher in such a way that the conductivity sensor is directly sprayed with rinse water by a spray arm during operation of the dishwasher. The control unit and the conductivity sensor are configured in such a way that a discontinuous, discrete resistance measurement is taken at the conductivity sensor.

In addition, temperature sensors in cleaning appliances are also known, for example for monitoring a temperature of the cleaning fluid and/or for monitoring a hygienization effect of the cleaning appliance. In this respect, reference can be made for example to the above-mentioned prior art documents. In particular in the case of cleaning and disinfecting devices, temperature sensors are provided, corresponding to the requirements of DIN ISO 15883-1. Periods of redundancy can even be scheduled during the temperature measurement.

DE 197 32 856 A1 describes a cleaning machine and a monitoring method. Here, a spray arm is used, which can be set in rotation by fluid discharged from said spray arm. A sensor is also used, which detects the rotational movement of the spray arm. The sensor is a force sensor, which detects the force applied by the water jets.

DE 10 2007 042 076 A1 discloses a dishwasher having at least one recirculation pump. This document discloses, inter alia, the provision of sensors in one or more wash arms. The sensors can be temperature and/or conductivity sensors, for example.

EP 1 306 045 A1 describes an appliance for monitoring a rinsing process in a dishwasher. The appliance is a standalone, watertight unit, which for example simulates an article to be cleaned. A force-sensitive sensor is provided on the device, which sensor for example is embodied as a sensor having a force-dependent resistance for detecting the impingement of liquid jets.

In addition, flow monitors are known in principle, which for example are based on the principle that a paddle within a flow path is deflected by the flowing medium. The deflection is generally identified by means of at least one sensor and/or switch. In addition, the use of pressure sensors which can detect a pressure in a washing system and can convey a corresponding signal to a device control unit is possible in principle in cleaning and disinfecting devices. With a possible arrangement of this type, it is possible within certain limits to determine whether cleaning fluid is being discharged from the nozzles.

In spite of the monitoring of a large number of parameters in the cleaning appliances known from the prior art, technical challenges remain in practice with regard to the control and monitoring of the cleaning process. One technical challenge thus lies in the fact that in many cases it is not possible to determine whether cleaning fluid is being discharged as desired from the nozzles. This deficiency in many cases prevents a monitoring function and makes it impossible to confirm the cleaning effect of the cleaning appliance. This deficiency is problematic in particular in light of increasing hygiene demands, since, in addition to the temperature, the chemistry, and the exposure time, what are known as the rinsing mechanics, i.e. the mechanical effect of the fluid jets on the articles to be cleaned, can also have a significant influence on the cleaning result. Not even the pressure measurement in a line system used in cleaning and disinfecting devices can fully overcome this deficiency, which is caused by the above-mentioned principle. By way of example, a system pressure can correspond absolutely to the desired specifications, whereas a spray pattern of the nozzles is not correctly configured at all nozzles. Accordingly, a simple, flexible, reliable method that can be adapted to different cleaning programs or operating states in order to monitor a jet behavior of one or more nozzles of the cleaning appliance would be desirable.

Measurement methods that measure the pressure directly (pressure sensor, pressure monitor) or indirectly (sensory detection of a change in position of a component caused by pressure) have in principle a very high dependency on the operating regime. By way of example, on account of the treatment of articles to be cleaned that have different sensitivities, a dishwasher can also provide programs having different pressures stages. In this respect, for a reliable evaluation of the pressures, the control unit system must also know the variance of the applications and the associated tolerance bands. Lastly, these variables must be parameterized. The use of a redundant temperature measurement system does not deliver any information that goes beyond the actual determination.

OBJECT OF THE INVENTION

The object of the present invention is therefore to provide a cleaning appliance and a method for cleaning articles to be cleaned, which at least largely avoid the disadvantages of known appliances and methods of the specified type. In particular, a simple, flexible, reliable method that can be adapted to different cleaning programs or operating states will be provided, in order to monitor a jet behavior of one or more nozzles of a cleaning appliance.

DISCLOSURE OF THE INVENTION

This object is achieved by a cleaning appliance and by a method for cleaning articles to be cleaned and also by a use, these having the features of the independent claims. Advantageous developments, which can be realized individually or in any combination, are presented in the dependent claims.

Hereinafter, the terms "have", "contain", "comprise" or "include" or any grammatical deviations thereof will be used non-exclusively. Accordingly, these terms can relate both to situations in which, besides the features introduced by these terms, no further features are present, or to situations in which one or more further features is/are present. By way of example, the expression "A has B", "A contains B", "A comprises B" or "A includes B" can relate both to situations in which, apart from B, no further element is present in A (i.e. to a situation in which A consists exclusively of B) and to the situation in which, in addition to B, one or more further elements is/are present in A, for example element C, elements C and D, or even further elements.

Furthermore, the terms "preferably", "in particular", "for example" or similar terms will be used hereinafter in conjunction with optional features, without alternative embodiments being limited as a result. Features which are introduced by these terms are optional features, and there is no intention to limit the scope of protection of the claims and in particular of the independent claims by these features. As a person skilled in the art will be aware, the invention can thus be carried out with use of other embodiments as well. Similarly, features which are introduced by "in one embodiment of the invention" or by "in one exemplary embodiment of the invention" will be understood to be optional features, without intending to hereby limit alternative embodiments or the scope of protection of the independent claims. Furthermore, all possibilities for combining the features introduced hereby with other features, whether optional or non-optional features, will remain unaffected by these introductory expressions.

In a first aspect of the present invention a cleaning appliance for cleaning articles to be cleaned is proposed. Here, a cleaning appliance is to be understood generally within the scope of the present invention to mean an appliance which is designed to free articles to be cleaned of adhering macroscopic and also microscopic contaminations or to remove contaminations of this type at least in part. In addition, a disinfecting effect can be exerted optionally. The cleaning effect in the cleaning appliance can be based here for example on the mechanical effect of at least one cleaning fluid, but can also be based at least in part on the effect of disinfecting media, such as steam.

Articles to be cleaned are to be understood generally within the scope of the present invention to mean any items which can be cleaned by means of the cleaning appliance. Here, one item can be cleaned, or a plurality of items can be cleaned simultaneously or sequentially. In particular, the articles to be cleaned may be items which are used directly or indirectly for the preparation, storage or presentation of food, i.e. for example crockery, cutlery, trays, dishes, glassware, pots, pans or similar items. Accordingly, the cleaning appliance can be embodied in particular as a dishwasher, for example as a dishwasher for commercial use in canteen kitchens or communal catering kitchens. Alternatively, however, the cleaning appliance, as will be explained in greater detail further below, can also be embodied for example for the cleaning of containers for receiving human excretions, for example bedpans. Accordingly, the cleaning appliance can be embodied for example as what is known as a cleaning and disinfecting device (CDD). Other embodiments of the cleaning appliance and/or of the articles to be cleaned are possible in principle.

The cleaning appliance comprises at least one cleaning chamber and at least one nozzle for applying at least one cleaning fluid to the articles to be cleaned within the cleaning chamber. Here, a cleaning chamber is generally understood within the scope of the present invention to mean a fully or partly closed chamber, within which the cleaning process can be performed in full or in part. The cleaning chamber can in particular have at least one housing, which surrounds the cleaning chamber wholly or in part. Here, a single cleaning chamber can be provided, or a plurality of cleaning chambers can be provided, for example sequentially. The cleaning chamber can include for example at least one opening for loading the cleaning chamber with the articles to be cleaned. By way of example, this one opening can be a hatch arranged on a front side of the cleaning chamber and/or an upper side of the cleaning chamber. Alternatively, hoods are also possible for closing the cleaning chamber, for example within the scope of what are known as hood-type dishwashers. Again alternatively, the cleaning chamber can also be embodied for example wholly or in part as a tunnel, for example within the scope of what are known as pass-through dishwashers.

A nozzle for applying at least one cleaning fluid to the articles to be cleaned is to be understood generally here within the scope of the present invention to mean a device which contains at least one opening, from which the cleaning fluid can be discharged into a free space within the cleaning chamber, for example in the form of a jet or also in the form of drops. The nozzle can be supplied with the cleaning fluid for example by means of at least one feed line. A combination of a plurality of nozzles can also be provided, as explained in greater detail further below, for example a combination of a plurality of stationary nozzles and/or a combination of nozzles mounted movably within the cleaning chamber, for example nozzles of a spray arm.

A cleaning fluid is to be understood within the scope of the present invention to mean a liquid or a gas which, as it contacts the articles to be cleaned, can provide a cleaning effect. In particular, the cleaning fluid can comprise an aqueous liquid, for example water and/or water having one or more additives, for example having one or more cleaning concentrates and/or final rinse agents and/or disinfectants. Alternatively or additionally, the cleaning fluid may also comprise steam, for example. The cleaning appliance can be designed to use an individual cleaning fluid or also to use a combination of a number of cleaning fluids. If a plurality of cleaning fluids are provided, the different cleaning fluids can be applied to the articles to be cleaned at the same time or also sequentially. By way of example, the articles to be cleaned can remain in a stationary manner within the cleaning chamber and can be exposed in succession to the different cleaning fluids. Alternatively, the articles to be cleaned can also be conveyed through a plurality of regions of the cleaning chamber, for example by means of at least one transport device, wherein different types of cleaning fluid can be applied in the different regions. The latter situation is the case known for example in a pass-through dishwasher.

The cleaning appliance also comprises at least one temperature sensor. Here, a temperature sensor is to be understood generally within the scope of the present invention to mean a sensor which can generate at least one sensor signal, in particular an electrical sensor signal, for example an analogue signal and/or a digital signal, from which a conclusion can be drawn as to the temperature in the region of the temperature sensor. By way of example, the sensor signal of the temperature sensor, at least in a measurement region, can be proportional to a temperature in the region of the temperature sensor. Other correlations between the sensor signal and the temperature are also possible and are known in general. By way of example, the temperature sensor can comprise at least one temperature-dependent resistor, for example at least one NTC resistor, i.e. a resistor having a negative temperature coefficient, and/or at least one PTC resistor, i.e. a resistor having a positive temperature coefficient. Other embodiments are also possible in principle.

The temperature sensor is arranged in at least one desired jet region of the at least one nozzle. If a plurality of nozzles are provided, one or more temperature sensors can be arranged in each desired jet region of each of these nozzles, or also just in one desired jet region of one of these nozzles or in a plurality of desired jet regions of a plurality of these nozzles. In this way, if a plurality of nozzles are provided, one, more, or all desired jet regions of the nozzles is/are monitored. A desired jet region of a nozzle is to be understood here generally within the scope of the present invention to mean a spatial region which, depending on the particular operation of the cleaning appliance, is reached by the cleaning fluid discharged from the nozzle when the nozzle is working properly and as desired, i.e. for example is not blocked or constricted. By way of example, the desired jet region can be a conical, fan-shaped or club-shaped region in front of the nozzle, which is reached by the cleaning fluid discharged from the nozzle. The desired object region can be dependent here on the particular operating state of the cleaning appliance and/or of the nozzle. In different operating states, for example in different program steps of a cleaning program, different types of cleaning fluid can thus be discharged from the nozzle, which can accordingly have different desired jet regions. Alternatively or additionally, cleaning fluid having a different speed and/or different pressure for example can also be discharged from the same nozzle in different program steps, such that the desired jet region can naturally also be modified by this modification of speed. This modification however can be determined empirically or analytically and can thus be known in general. The desired jet region of a properly working nozzle can thus be determined, known, or at least determinable, for example with a certain spatial uncertainty, in the particular cleaning program and/or at the particular moment in time.

By contrast, an actual jet region or also simply a jet region of the nozzle is to be understood to mean the region actually reached by the cleaning fluid discharged from the nozzle, inclusive where appropriate of undesirable modifications, such as missing reached surface regions possibly caused by a blockage and/or constriction of the nozzle. Accordingly, the actual jet region of the nozzle can deviate for example spatially from the desired object region, for example can be shifted and/or displaced with respect thereto, and/or can be smaller than the desired jet region. The actual jet region can in particular also be reduced completely to 0, for example when the nozzle in question is blocked.

The cleaning appliance also comprises at least one control unit. A control unit is to be understood within the scope of the present invention to mean a one-part or multi-part device of the cleaning appliance designed to fully and/or partly control and/or to regulate the operation of the cleaning appliance. In particular, the control unit can be designed to modify, in particular to control and/or to regulate, one or more operating parameters of the cleaning appliance, for example at least one temperature, at least one pressure, at least one transport speed or also a combination of these specified and/or other operating parameters. The control unit can comprise in particular at least one data processing device, for example at least one processor. The control unit can be designed in terms of programming in particular for example in order to control at least one cleaning program of the cleaning appliance and in order to control or to carry out a method according to the invention. Furthermore, the control unit, as will be discussed in greater detail further below, can comprise at least one volatile and/or non-volatile data memory. The control unit can also comprise at least one interface, for example a man-machine interface for inputting commands and/or for outputting information, and/or a wireless or wired interface for unidirectional or bidirectional exchange of data and/or commands between the cleaning appliance and at least one further device. The control unit can in particular comprise at least one computer and/or at least one processor. The control unit can be in particular a central or decentralized machine control unit of the cleaning appliance.

The control unit is designed, for example by means of corresponding programming by one or more software programs, to analyze at least one sensor signal of the temperature sensor and to evaluate a jet behavior of the nozzle on the basis of the sensor signal. By way of example, the control unit can be programmed in order to analyze the sensor signal of the temperature sensor, for example by means of at least one software algorithm, which is stored in the control unit and/or runs on a processor of the control unit. Alternatively or additionally however, the control unit may also comprise one or more electronic components, which can analyze the sensor signal, for example by one or more electronic modules. Accordingly, the control unit can be established in full or in part by hardware or also, alternatively or additionally, in full or in part by software.

An analysis of a sensor signal is to be understood generally to mean a further processing of the sensor signal and/or a process in which the sensor signal is processed and/or monitored. An evaluation of the jet behavior of the nozzle on the basis of the sensor signal is to be understood here generally to mean a generation of at least one piece of information regarding the jet behavior of the nozzle. The jet behavior of the nozzle is to be understood generally to mean information as to whether the nozzle is working properly, i.e. within the scope of a predefined norm, or whether there are deviations from the predefined norm. If deviations are occurring, these deviations can also be quantified for example within the scope of the evaluation of the jet behavior of the nozzle. The jet behavior can thus be understood generally to mean information as to how the cleaning fluid is being discharged from the nozzle, inclusive of a spatial distribution of the discharging cleaning fluid and/or inclusive of an actual jet region.

It is thus in particular possible within the scope of the present invention to use the at least one temperature signal of the at least one temperature sensor in order to determine, as a result of a wetting of the temperature sensor with the cleaning fluid, whether cleaning fluid is reaching and wetting the temperature sensor to the expected level. As a result of the wetting of the temperature sensor with the cleaning fluid, a temperature of the temperature sensor can be changed, for example by supplying or removing heat to/from the temperature sensor by means of the wetting by the cleaning fluid. The change in temperature can be detected in turn by means of the at least one sensor signal. The information as to whether cleaning fluid is present or not at certain locations within the cleaning chamber can thus be provided by means of a detection of the corresponding temperature at the respective locations. This can be implemented in particular when the temperature of the cleaning fluid deviates from an ambient temperature within the cleaning chamber, such that the impingement of the cleaning fluid on the temperature sensor and a wetting thereof lead to a modification of the temperature of the temperature sensor.

The evaluation of the jet behavior of the nozzle on the basis of the sensor signal can be implemented in particular by checking whether the relevant temperature sensor is actually at the expected temperature, for example the temperature of the cleaning fluid, at a location at which contact with the cleaning fluid is expected with correct jet behavior of the nozzle. In this way, the jet dynamics, the washing mechanics, or generally the jet behavior of the at least one nozzle can be checked without complex mechanical sensors.

The cleaning appliance can contain in particular at least one temperature-control device for heating the cleaning fluid. A temperature-control device is to be understood generally within the scope of the present invention to mean a device which can change a temperature of the cleaning fluid. In particular, the temperature-control device can contain at least one heating device. The temperature-control device can be selected in particular from the group consisting of: a boiler; a flow-type heater; a heating coil; a hot water connection point for connection to a hot water connection point located in a building. Various embodiments and also combinations of the specified and/or other embodiments are possible. The temperature-control device can be designed in particular in such a way that a temperature of the at least one cleaning fluid lies above an ambient temperature within the cleaning chamber and/or above an ambient temperature of the cleaning appliance. By way of example, the temperature-control device can be designed in such a way that the cleaning fluid is heated to a temperature of at least 40° C., in particular at least 50° C., or at least 60° C., and particularly preferably higher temperatures, such as temperatures in the range from 80° C. to 100° C., for example 85° C. to 95° C. Here, if a plurality of cleaning fluids are provided and/or a plurality of liquid circuits are provided, the different cleaning fluids can have different temperatures. By way of example, the temperatures of the cleaning fluid may be between 40° C. and 60° C. in a wash tank, and between 85° C. and 95° C. in a secondary rinse tank.

The cleaning appliance, in particular the control unit, can be designed in particular to compare the sensor signal of the temperature sensor with at least one desired signal and to evaluate the jet behavior of the nozzle on the basis of this comparison. Here, the at least one sensor signal of the at least one temperature sensor can be compared directly with the at least one desired signal, or at least one secondary signal of the temperature sensor can be formed for example by signal processing of the at least one sensor signal. Again alternatively or additionally, the sensor signal and/or the secondary signal of the sensor signal can be processed in full or in part, for example in order to determine at least one temperature value. All of the specified possibilities, i.e. the use of the sensor signal itself, the use of a secondary signal derived from the sensor signal, or also the use of at least one temperature value derived from the sensor signal or the secondary sensor signal, are to be understood within the scope of the present invention by the term "sensor signal", such that no distinction is made between the specified options. Accordingly, the desired signal may be an electronic signal of analogue type or digital type or may also be a measurement value, for example a desired temperature value. Generally, the desired signal is at least one signal which corresponds to the expected sensor signal when the nozzle is working correctly, i.e. when the nozzle has a jet behavior corresponding to normal behavior in the current operating state. This desired signal by way of example can be determined analytically, semi-empirically or also empirically, for example by including one or more sensor signals when the nozzles are working correctly and using this/these as desired signal or desired signals.

Evaluation of the jet behavior of the nozzle on the basis of the comparison of the sensor signal with the desired signal is to be understood generally to mean a process in which information regarding an agreement of the two signals and/or a deviation of the two signals from one another is determined on the basis of the comparison of the sensor signal with the desired signal and in which the jet behavior of the nozzle is evaluated on the basis of this information. By way of example, as discussed in greater detail further below, this information can be a signal difference between the sensor signal and the desired signal, or vice versa. Alternatively or additionally however, the formation of a quotient can also be used for example, in which case the sensor signal is divided by the desired signal, or vice versa. More complex analysis formulas which include the sensor signal and the desired signal can also be used in order to obtain information regarding the jet behavior.

The at least one piece of information can be compared for example with at least one threshold value and/or can be checked in order to determine whether this piece of information lies in at least a normal range or matches at least one normal value. Information can thus be obtained regarding whether the jet behavior of the nozzle matches normal behavior or deviates from said normal behavior.

The cleaning appliance, in particular the control unit can thus preferably be designed in such a way that at least one comparison value is determined on the basis of the comparison, wherein the comparison value can be compared with at least one threshold value and a measure for the jet behavior of the nozzle can be determined on the basis of this comparison of the comparison value with the at least one threshold value. A measure for the jet behavior of the nozzle can be understood to mean any information regarding whether or not the jet behavior of the nozzle matches at least a normal behavior. If a deviation is determined, this deviation can be quantified, for example also within the scope of the measurement for the jet behavior of the nozzle. By way of example, an agreement with a normal behavior can be specified in the form of a percentage. Alternatively however, simply a digital value can be determined as a measure for the jet behavior, wherein the digital value by way of example includes simply information as to whether the jet behavior of the nozzle lies within a predefined or predefinable or determinable normal range or deviates from this normal range.

The cleaning appliance, in particular the control unit, can also be designed to compare the sensor signal of the temperature sensor, inclusive of the above-mentioned options of forming one or more secondary signals and/or derived values, with at least one temperature of the cleaning fluid. At least one temperature can thus be determined initially from the at least one sensor signal, which temperature can also be referred to as the actual temperature, and this temperature can be compared with at least one known or determinable temperature of the at least one cleaning fluid, for example in a tank of the cleaning fluid and/or in a feed line of the cleaning fluid. Alternatively or additionally, at least one desired sensor signal can also be derived from the known or determinable temperature of the cleaning fluid, and the sensor signal of the temperature sensor, i.e. the actual sensor signal, can be compared with the at least one desired sensor signal. Various other possibilities are conceivable.

In order to determine the temperature of the cleaning fluid, i.e. the actual temperature or a corresponding actual temperature signal, the cleaning appliance can also contain at least one comparison temperature sensor for detecting the temperature of the cleaning fluid. This comparison temperature sensor, which can also be referred to as a reference temperature sensor, can be arranged for example in at least one tank for receiving the cleaning fluid and/or in at least one line of the cleaning fluid. With regard to possible embodiments of the comparison temperature sensor, reference can be made to the above-mentioned possibilities of the temperature sensor. It is particularly preferable when the comparison temperature sensor is substantially structurally identical to the temperature sensor. In this case the sensor signals of the temperature sensor and the comparison temperature sensor can be directly compared with one another without difficulty, for example by means of a simple electronic circuit, in particular a simple amplifier circuit and/or an operational amplifier and/or a comparator. Other possibilities can also be implemented alternatively or additionally, for example software-based solutions.

The cleaning appliance can be designed in particular to determine at least one temperature difference from the sensor signal of the temperature sensor and the temperature of the cleaning fluid. A temperature difference is generally to be understood to mean a measure for a deviation of the actual temperature, which can be determined directly or indirectly from the sensor signal of the temperature sensor, and a desired temperature in the form of the temperature of the cleaning fluid or a variable derived from this temperature of the cleaning fluid. The temperature difference can accordingly be specified in particular in temperature units. Alternatively or additionally however, the temperature difference can also be specified in other units or in a dimensionless manner, for example in the form of a deviation of two signals, specifically the sensor signal of the temperature sensor and a signal of the comparison temperature sensor.

The cleaning appliance, in particular the control unit, can also be designed to compare the at least one temperature difference with at least one threshold value. By way of example, this threshold value can comprise at least one predefined and/or predefinable and/or determinable numerical value for the temperature difference. This at least one threshold value can be manually predefined for example and/or can be predefined or determined by the control unit itself, for example by pre-defining tolerable deviations. The cleaning appliance, in particular the control unit, can also be designed to determine a defective discharge behavior of the nozzle when the temperature difference or a value of the temperature difference reaches the threshold value or exceeds the threshold value. In general, at least one tolerance range can be predefined for example, wherein, when the temperature difference of the value lies within the tolerance range, normal behavior of the nozzle is concluded, and wherein, when the temperature difference or the value thereof lies outside the tolerance range, defective jet discharge of the nozzles can be determined.

The at least one threshold value, wherein a plurality of threshold values can also be used, can be selected in particular from the group consisting of: a fixedly predefined threshold value; a threshold value predefined by a current cleaning program of the cleaning appliance; an adjustable threshold value; a threshold value that can be determined by means of at least one current operating parameter of the cleaning appliance. Various possibilities are conceivable.

As discussed above, the at least one sensor signal of the at least one temperature sensor, and also analogously the at least one comparison temperature signal of the at least one comparison temperature sensor, can comprise at least one raw signal and/or at least one secondary signal derived from this raw signal and/or at least one value derived from this raw signal and/or derived secondary signal. The sensor signal can also be selected in particular from the group consisting of: a current measured value of the at least one temperature sensor; a mean value of a plurality of measured values of the at least one temperature sensor, in particular a temporal mean value and particularly preferably an ongoing mean value; a filtered measured value of the at least one temperature sensor. Accordingly, as described above, different processing and/or analyses of the at least one sensor signal are possible, for example in order to implement a filtering and/or smoothing. The cleaning appliance can be designed in particular to detect a time curve of the at least one sensor signal of the at least one temperature sensor and/or a time curve of the jet behavior of the at least one nozzle. By way of example it is thus possible to determine when the jet behavior of the at least one nozzle changes with the scope of operation of the cleaning appliance, for example when the at least one nozzle becomes blocked during operation of the cleaning appliance.

The cleaning appliance can comprise, as discussed above, one or more temperature sensors. Similarly, one or more of the comparison temperature sensors can be provided. The cleaning appliance can contain in particular a plurality of the temperature sensors at different locations within the cleaning chamber, and the cleaning appliance, in particular the control unit, can be designed in particular to detect a spatial profile of a temperature within the cleaning chamber. The cleaning appliance, in particular the control unit, can also be designed to detect a time curve of the spatial profile of the temperature. The time curve of the spatial profile of the temperature can be stored in particular in at least one data memory, for example in at least one volatile and/or at least one non-volatile data memory of the control unit. A hygienization effect of the cleaning process can furthermore also be determined from the spatial profile of the temperature and/or the time curve thereof, for example with use of known methods, for example by detecting the application of a thermo-equivalent to the articles to be cleaned. In this respect, reference can be made by way of example to the above-mentioned prior art.

The cleaning appliance, in particular the control unit, can also be designed, when the jet behavior of the nozzle demonstrates a deviation from a predefined norm or a predefined normal range, to execute at least one predefined action. This at least one action can be executed in particular automatically. The action can be selected in particular from the group consisting of: an output of an error message; an output of a notification message; a stopping of the cleaning process; a stopping of a transport device of the cleaning appliance; a modification of a speed of a transport device of the cleaning appliance, in particular a reduction of the speed; a modification of a temperature of the at least one cleaning fluid, in particular a modification of a temperature of the at least one cleaning fluid in at least one tank, preferably an increase of the temperature; a modification of washing mechanics of the cleaning appliance; a logging of the deviation of the jet behavior in at least one log; a transmission of an electronic message regarding the deviation of the jet behavior, in particular via at least one electronic interface and particularly preferably by means of e-mail and/or SMS. A combination of the specified actions and/or other actions is also conceivable.

The cleaning appliance can be, as described above, in particular a dishwasher and/or a cleaning and disinfecting device. The cleaning appliance can thus be selected in particular from the group consisting of: a one-chamber dishwasher, in particular a batch dishwasher and particularly preferably a commercial one-chamber dishwasher having at least two tanks for receiving cleaning fluid; a pass-through dishwasher, in particular a flight-type dishwasher and/or a rack conveyor dishwasher; a cleaning and disinfecting device (CDD) for cleaning containers for receiving a human excretions. Reference can be made in general to the prior art, for example to the above-mentioned prior art, in respect of possible embodiments of cleaning appliances of this type.

The cleaning appliance can comprise in particular a plurality of nozzles. The plurality of nozzles can be arranged in particular completely or in part in a spray arm. Here, a spray arm is to be understood generally to mean a tubular device which extends along a straight or curved axis and along which a plurality of the nozzles are arranged. The spray arm can be in particular a rotatably mounted spray arm.

The cleaning appliance can comprise in particular a plurality of the temperature sensors in the at least one desired jet region of the at least one nozzle. If a plurality of nozzles are provided, a plurality of temperature sensors can thus be arranged in different desired jet regions of different nozzles, as discussed above. By way of example, at least one nozzle can be arranged in at least one of said jet regions, in a plurality of said jet regions, or in all of said jet regions.

If a plurality of nozzles are provided, it is regularly the case in practice that at least one of the nozzles is known to be particularly susceptible to malfunction. By way of example, this may be, as described in greater detail further below, a last nozzle in a row of nozzles, for example a nozzle which is reached last by an approaching cleaning fluid, for example a nozzle arranged furthest outwardly in a spray arm, said nozzle being furthest from a feed point. The temperature sensor can in particular be arranged in at least one desired jet region of the nozzle known to be susceptible to malfunction. The nozzle known to be susceptible to malfunction can thus comprise, as discussed above, in particular at least one nozzle at the end of a spray arm. Alternatively or additionally, the nozzle known to be susceptible to malfunction can also be, for example, a nozzle which is used in practice to drive a spray arm. Accordingly, the spray arm may be in particular a rotatably mounted spray arm, wherein the nozzle can be arranged in such a way that the cleaning fluid discharging from said nozzle provides the rotatably mounted spray arm with an angular momentum. Since nozzles of this type are known in practice to be susceptible to malfunction, it is particularly preferred when the at least one temperature sensor or, if a plurality of temperature sensors are provided, at least one of these temperature sensors is arranged in the desired jet region of the specified nozzle for driving the spray arm.

In a further aspect of the present invention a method for cleaning articles to be cleaned is proposed. In the method at least one cleaning appliance having at least one cleaning chamber and at least one nozzle for applying at least one cleaning fluid to the articles to be cleaned in the cleaning chamber is used. In the method at least one temperature sensor is also used, wherein the temperature sensor is arranged in at least one desired jet region of the nozzle. The method comprises an analysis of at least one sensor signal of the temperature sensor and an evaluation of a jet behavior of the nozzle by means of the sensor signal.

With regard to possible embodiments of the method, reference can be made largely to the above description of the cleaning appliance. The cleaning appliance can thus be in particular the cleaning appliance according to one or more of the above-mentioned embodiments or according to one or more of the embodiments yet to be described hereinafter. Conversely, the cleaning appliance, in particular the control unit of the cleaning appliance, can be designed to carry out a method according to the invention.

Accordingly, the method can comprise in particular at least one comparison of the sensor signal of the temperature sensor with at least one desired signal and at least one evaluation of the jet behavior of the nozzle on the basis of this comparison. During the comparison, at least one comparison value can be determined in particular, wherein the comparison value can be compared with at least one threshold value and a measure for the jet behavior of the nozzle can be determined on the basis of this comparison of the comparison value with the at least one threshold value.

In the method, at least one comparison of the sensor signal of the temperature sensor with at least one temperature of the cleaning fluid can be performed. The cleaning appliance can contain in particular at least one comparison temperature sensor for detecting the temperature of the cleaning fluid, in particular at least one comparison temperature sensor in at least one tank for receiving the cleaning fluid and/or in at least one line of the cleaning fluid. Within the scope of the present method, as described above in conjunction with the cleaning appliance, at least one temperature difference in particular can be determined from the sensor signal of the temperature sensor and the temperature of the cleaning fluid. The temperature difference can be compared in particular with at least one threshold value. Here, a defective jet behavior of the nozzle in particular can be concluded when the temperature difference or a value of the temperature difference reaches the threshold value or exceeds the threshold value. In particular, a defective jet behavior of the nozzle can be concluded when the temperature difference lies outside a predefined tolerance range. The threshold value can be selected in particular from the group consisting of: a fixedly predefined threshold value; a threshold value predefined by a current cleaning program of the cleaning appliance; an adjustable threshold value; a threshold value that can be determined by means of at least one current operating parameter of the cleaning appliance.

As discussed above, the sensor signal can comprise in particular at least one raw signal, at least one secondary signal, or also at least one value derived from the raw signal and/or secondary signal. In particular, the sensor signal can be selected from the group consisting of: a current measured value of the at least one temperature sensor, in particular at least one raw signal; a mean value of a plurality of measured values of the at least one temperature sensor, in particular a temporal mean value and particularly preferably an ongoing mean value; a filtered measured value of the at least one temperature sensor. Other embodiments are also possible.

As discussed above, the method can comprise in particular a detection of a time curve of the jet behavior of the nozzle. The cleaning appliance can also contain a plurality of the temperature sensors at different locations within the cleaning chamber, and the method can also comprise a detection of at least one spatial profile of a temperature within the cleaning chamber. A time curve of the spatial profile of the temperature can also be detected, and the time curve of the spatial profile of the temperature can be stored within the scope of the present method preferably in at least one data memory.

The method can also comprise the execution of at least one predefined action, in particular an automatic execution, when the jet behavior of the nozzle demonstrates a deviation from a predefined norm or a predefined normal range. As discussed above, the action can be selected in particular from a group of particular actions, wherein reference can also be made to the above description of the cleaning appliance.

Reference can also be made to the above description of the cleaning appliance with regard to possible embodiments of the cleaning appliance which can be used within the scope of the present method.

In a further aspect of the present invention a use of at least one temperature sensor in a desired jet region of a nozzle of a cleaning appliance for the evaluation of a jet behavior of the nozzle is proposed. Reference can be made to the above description of the cleaning appliance and/or the method for further possible embodiments of the use.

The cleaning appliance, in particular the control unit, can be designed within the general scope of the present invention in particular to monitor a thermal hygienization effect on articles to be cleaned under consideration of the temperature during at least one cleaning program. As discussed above, the at least one sensor signal of the at least one temperature sensor can also be used for this purpose. By way of example, thermo-equivalents can be calculated during the cleaning program by tracking the temperature applied to the articles to be cleaned, and a current calculation of the application of thermo-equivalents, also referred to as heat equivalents, can be made. In particular, a temperature distribution within the cleaning chamber during application of heat equivalents can be taken into consideration. By way of example, it can thus be ensured that all articles to be cleaned following the cleaning meet minimum hygiene requirements in respect of hygienization, even if an inhomogeneous temperature distribution occurs within the cleaning chamber. In addition, it can be taken into consideration that a jet behavior of one or more of the nozzles deviates from a desired jet behavior, and the hygienization can be determined by way of example by means of the actual application of heated cleaning fluid to the articles to be cleaned. By way of example, standards can be used for this purpose, such as the standard DIN EN ISO 15883 and/or the NSF 3 standard. By way of example, the cleaning appliance can be designed to record during the cleaning program an application of thermo-equivalents to the articles to be cleaned, for example selected from A0 values and/or H.U.E. values. Reference can be made in this regard for example to the above-mentioned documents DE 10 2004 056 052 A1 and/or DE 10 2007 025 263 A1 and the methods and appliances specified there.

The cleaning appliance according to the invention and the method according to the invention have numerous advantages compared with known methods and devices of the specified type. The cleaning appliance and the method can thus be designed in particular to characterize, in a simple and reliable manner, the jet behavior and washing mechanics caused by one or more jets of the cleaning fluid. In order to monitor the washing mechanics in the jet region of the at least one nozzle, at least one temperature sensor can thus be mounted at a certain distance. Here, the distance and/or the position is/are to be selected appropriately such that the function of the nozzle is not hindered and such that, in the event of a defective spray pattern, for example in the extreme case of a complete failure of a jet, the at least one temperature sensor is no longer wetted or is no longer sufficiently wetted by cleaning fluid.

The at least one temperature sensor can advantageously be placed in at least one desired jet region of at least one nozzle which is known to be critical for soiling and/or blockage. In practice, it has been found that every washing system generally contains characteristic nozzles of this type. By way of example, in the case of elongate washing systems having a plurality of nozzles on a tubular spray arm, the last or outer nozzles, which are arranged furthest from a feed point, are generally those that are most susceptible to malfunctions on account of blockages. The reason for this generally lies in the fact that particles of dirt are driven past all nozzles with the flow in the spray arm, as far as the last nozzle. At the last or outermost nozzle there is generally still only a flow to the discharge cross section of the nozzle, where any particles of dirt also possibly present are then carried. If the particles of dirt are too big for the cross section of the nozzle, these remain attached to the nozzle and block the nozzle. Such effects can be detected in practice only with difficulty, by way of example by means of flow sensors. Malfunctions of this type, however, can be identified by means of the proposed invention, for example since a temperature sensor in a desired jet region of the outermost nozzle can easily detect a deficient wetting.

In the case of washing systems having spray arms which rotate, the outermost nozzles are additionally also provided in many cases to drive the spray arm. If a nozzle of this type becomes blocked, the spray arm no longer rotates, and the washing mechanics in the cleaning chamber are disturbed. This effect can also be identified without difficulty by means of the proposed invention.

By measuring the temperature using the at least one temperature sensor in the desired jet region of the nozzle and for example by using a comparison with a measured temperature of an associated washing tank and/or storage tank of the cleaning fluid, it is possible to reliably identify whether in particular the spray pattern of the nozzle equipped in the described manner is correct. This conclusion can be drawn since for example in many cases the temperature detected by means of the at least one temperature sensor and the temperature in the tank are approximately the same. If, by contrast, the at least one temperature sensor is not wetted or is no longer sufficiently wetted, there are generally inevitably differences, since the ambient temperature of the sensor in the washing zone generally deviates from the temperature of the cleaning fluid in the tank.

When the cross section of the monitored nozzle is only constricted, it is anticipated that the jet will not be formed in an optimal manner. The actual jet region and/or the actual spray pattern of the nozzle thus deviate from a desired object region and/or a desired spray pattern of the nozzle in the event of a constriction of the nozzle or a blockage of the nozzle. In the event of a constriction of the nozzle, a temperature difference between the sensor signal of the at least one temperature sensor and the temperature of the cleaning fluid, for example in the at least one tank, will also become evident for example in many cases at some distance from the discharge opening of the nozzle, such that constrictions of the nozzle can also be identified in a simple and reliable manner. Deviations of the jet behavior of the nozzle from a desired jet behavior can thus be identified generally in a simple and reliable manner, for example deviations caused by a blockage of the nozzle and/or deviations caused by a constriction of the nozzle.

The deviations of the jet behavior from a desired jet behavior can be identified, as discussed above, for example by simply establishing a difference, wherein for example a difference between the at least one sensor signal of the at least one temperature sensor and/or at least one secondary signal derived therefrom and a temperature of the cleaning fluid and/or a variable correlating thereto is formed. By way of example, the control unit can be designed to form a difference from the at least one measured value of the comparison temperature sensor, also referred to as a reference sensor, for example in the at least one tank, and the at least one sensor signal. By way of example, the control unit can also be designed to check whether this difference or, which is considered to be equivalent within the scope of the present invention, a value of this difference is acceptable or not, for example by means of a comparison with at least one threshold value. The threshold value can be detected for example in a tabular manner, can be parameterized, or by way of example can be fixedly programmed.

Besides the consideration of the at least one difference, the time curve of the at least one sensor signal and/or the at least one difference is/are also of interest in many cases. By way of example, it is thus possible, in order to improve a measured value stability, to revise the measured values of the at least one temperature sensor itself and/or a calculation result, for example the above-mentioned difference, by means of a signal processing, by way of example to smooth this/these using methods such as the formation of an ongoing mean value. A decision as to which algorithms are used for this in detail can be made in principle individually in each case. Here, corresponding conclusions can be drawn generally for example on the basis of the difference and reliable tolerance thereof and also optionally on the basis of a time-dependent modification of the temperature by the control unit. By way of example, is possible to decide, in particular automatically, whether a cleaning method is being carried out as desired and whether or not an action is necessary accordingly.

The method and/or the cleaning appliance, in particular the control unit of the cleaning appliance, can thus be designed in such a way that at least one action is executed, in particular automatically, when the jet behavior of the nozzle demonstrates a deviation from a predefined norm or a predefined normal range. By way of example, this deviation can be identified on the basis of the above-mentioned difference.

Such actions can be, for example:

- outputting of error messages and/or notification messages,
- stopping of the entire process,
- stopping or modifying of a speed of a transport device of the cleaning appliance, for example of a transport dishwasher,
- modification of temperatures in one or more other washing tanks,
- modification of the washing mechanics in one or more other washing tanks,
- creation of log notes (for example in logs, batch reports, etc.),
- sending of messages (for example SMS, e-mail, etc.)

Other actions and/or combinations of the specified actions and/or other actions are also conceivable.

The embodiment of the method and/or of the cleaning appliance according to the invention can be realized particularly easily in washing systems of transport-type dishwashers. Washing systems of this type are embodied in many cases as a straight pipe, which is generally arranged in a stationary manner and usually transversely to a transport direction above and/or below the transport device, for example a conveyor belt. Rotating washing systems or washing systems moved in a different way can also be monitored using the described technique. In these systems a time curve, which likewise will deviate from a normal value in the event of malfunctions of the nozzle, is generally provided for the temperature at a temperature sensor in the jet region of the nozzle to be monitored, for example the characteristic nozzle known to be problematic.

The described principle according to the invention can be applied in principle to all nozzles within the cleaning appliance through which cleaning fluid is passed, for example a heated fluid medium.

The at least one temperature sensor can additionally be used also for other purposes in a multi-purpose function. In addition to the monitoring of the spray function of the at least one nozzle, the temperature sensor in the jet region of the nozzle can also by way of example sense the function of an additional sensor for a tank temperature. By way of example, the temperature of the cleaning fluid can be detected, wherein at the same time a correct forming of the spray pattern at the at least one nozzle can also be monitored.

In contrast to pressure measurements, the analysis of a temperature is additionally largely decoupled from potentially desired pressure changes during operation. By way of example, within the scope of a cleaning method and/or within the scope of an operation of the cleaning appliance, pressure changes may be desired and/or scheduled. By way of example, a program sequence can be provided, in which the cleaning fluid is applied to the articles to be cleaned at different times with different pressures of the cleaning fluid, for example in order to modify washing mechanics over time. This option is not hindered by the present invention. By way of example, it is generally irrelevant whether a rinse system operates with changing pressures and/or volume flows, provided the function actually desired is still provided. A measure for this will generally be the forming of the spray pattern of a nozzle. By means of the placement of the at least one temperature sensor, it is possible to define which modification of the jet behavior, for example the spray pattern of the nozzle or the area wetted by the jet from the nozzle, is detected and which is not. When the temperature sensor is placed for example close to the edge region of the desired target area, it will already detect a modification in the event of a smaller deviation of the spray pattern of the nozzle compared with when the temperature sensor is positioned centrally in the desired target area. An advantage of the method according to the invention is that no operation-specific parameterization is generally necessary, because the sensor signal, or values derived therefrom, can always be compared with the signal, or values derived therefrom, of the at least one temperature sensor, which controls the process. In addition to this fixed link, desired values for example can also be adapted to the particular cleaning program and/or to the particular cleaning situation.

The measurement of the temperature of the cleaning fluid being discharged from a nozzle, for example at a nozzle which is known to be critical, is particularly advantageous. If it is known for example that a particular nozzle will become blocked before all other nozzles, on account of the system, for example since this nozzle has a small cross section and/or is arranged at the end of a washing pipe, the function of the entire washing system, i.e. the totality of spray arms and spray nozzles, can thus be concluded reliably.

The use of one or more temperature sensors instead of or additionally to other types of sensors has further advantages. Temperature sensors, compared with other sensors, are generally economical, small, and easy to mount in a cleaning appliance. The outlay of electronic connection, wiring and/or an analysis of the signals of the temperature sensor is generally low. In addition, temperature sensors in practice have a high functional reliability.

In addition, a combination of redundant temperature measuring systems, which are necessary in many cases for other reasons, for example on account of corresponding hygiene standards, together with the monitoring of the spray pattern of a nozzle can constitute an advantageous twofold use of a single measuring device. Since these individual functions generally work and can be carried out independently of one another, an unfavorable mutual influencing of the individual functions generally is not anticipated. By contrast, the multiple use of a single sensor system is economical and saves resources.

In the case of cleaning and disinfecting devices, a plurality of nozzles are generally mounted in a manner distributed over the entire wall surface of the interior of the cleaning chamber. If the temperature sensors for monitoring the nozzle function are now used at a plurality of these nozzles, a temperature profile over the entire interior of the cleaning chamber or part thereof can additionally be detected with the aid of these temperature sensors, for example during a thermal disinfection, in particular a thermal disinfection with low-pressure steam, and can be processed and/or stored for example in a control unit of the cleaning and disinfecting device. A similar formation of a temperature profile over the entire interior of the cleaning chamber or part thereof is also possible with other types of cleaning devices.

To summarize, the following embodiments are preferred within the scope of the present invention:

Embodiment 1: a cleaning appliance for cleaning articles to be cleaned, said cleaning appliance comprising at least one cleaning chamber and at least one nozzle for applying at least one cleaning fluid to the articles to be cleaned within the cleaning chamber, said cleaning appliance further comprising at least one temperature sensor, wherein the temperature sensor is arranged in at least one desired jet region of the nozzle, said cleaning appliance further comprising a control unit, wherein the control unit is designed to analyze at least one sensor signal of the temperature sensor and to evaluate a jet behavior of the nozzle on the basis of the sensor signal.

Embodiment 2: the cleaning appliance according to the preceding embodiment, wherein the cleaning appliance contains at least one temperature-control device for heating the cleaning fluid.

Embodiment 3: the cleaning appliance according to the preceding embodiment, wherein the temperature-control device is selected from the group consisting of: a boiler; a flow-type heater; a heating coil; a hot water connection point for connection to a hot water connection point in a building.

Embodiment 4: the cleaning appliance according to any one of the preceding embodiments, wherein the cleaning appliance is designed to compare the sensor signal of the temperature sensor with at least one desired signal and to evaluate the jet behavior of the nozzle on the basis of this comparison.

Embodiment 5: the cleaning appliance according to the preceding embodiment, wherein the cleaning appliance is designed to determine a comparison value during the comparison, wherein the comparison value is compared with at least one threshold value and a measure for the jet behavior of the nozzle is determined from this comparison of the comparison value with the at least one threshold value.

Embodiment 6: the cleaning appliance according to any one of the preceding embodiments, wherein the cleaning appliance is also designed to compare the sensor signal of the temperature sensor with at least one temperature of the cleaning fluid.

Embodiment 7: the cleaning appliance according to the preceding embodiment, wherein the cleaning appliance contains at least one comparison temperature sensor for detecting the temperature of the cleaning fluid.

Embodiment 8: the cleaning appliance according to the preceding embodiment, wherein the comparison temperature sensor is arranged in at least one tank for receiving the cleaning fluid and/or in at least one line of the cleaning fluid.

Embodiment 9: the cleaning appliance according to any one of the three preceding embodiments, wherein the cleaning appliance is designed to determine at least one temperature difference from the sensor signal of the temperature sensor and the temperature of the cleaning fluid.

Embodiment 10: the cleaning appliance according to the preceding embodiment, wherein the cleaning appliance is also designed to compare the temperature difference with at least one threshold value.

Embodiment 11: the cleaning appliance according to the preceding embodiment, wherein the cleaning appliance is designed to determine a defective jet behavior of the nozzle when the temperature difference or a value of the temperature difference reaches the threshold value or exceeds the threshold value.

Embodiment 12: the cleaning appliance according to any one of the two preceding embodiments, wherein the threshold value is selected from the group consisting of: a fixedly predefined threshold value; a threshold value predefined by a current cleaning program of the cleaning appliance; an adjustable threshold value; a threshold value that can be determined by means of at least one current operating parameter of the cleaning appliance.

Embodiment 13: the cleaning appliance according to any one of the preceding embodiments, wherein the sensor signal is selected from the group consisting of: a current measured value of the at least one temperature sensor; a mean value of a plurality of measured values of the at least one temperature sensor, in particular a temporal mean value and particularly preferably an ongoing mean value; a filtered measured value of the at least one temperature sensor.

Embodiment 14: the cleaning appliance according to any one of the preceding embodiments, wherein the cleaning appliance is designed to detect a time curve of the jet behavior of the nozzle.

Embodiment 15: the cleaning appliance according to any one of the preceding embodiments, wherein the cleaning appliance contains a plurality of the temperature sensors at different locations within the cleaning chamber, wherein the cleaning appliance is designed to detect a spatial profile of a temperature within the cleaning chamber.

Embodiment 16: the cleaning appliance according to the preceding embodiment, wherein the cleaning appliance is designed to detect a time curve of the spatial profile of the temperature.

Embodiment 17: the cleaning appliance according to the preceding embodiment, wherein the cleaning appliance is designed to store the time curve of the spatial profile of the temperature in at least one data memory.

Embodiment 18: the cleaning appliance according to any one of the preceding embodiments, wherein the cleaning appliance is designed to execute at least one predefined action when the jet behavior of the nozzle demonstrates a deviation from a predefined norm or a predefined normal range.

Embodiment 19: the cleaning appliance according to the preceding embodiment, wherein the action is selected from the group consisting of: an outputting of an error message; an outputting of a notification message; a stopping of a cleaning process; a stopping of a transport device of the cleaning appliance; a modification of a speed of a transport device of the cleaning appliance, in particular a reduction of the speed; a modification of a temperature of the at least one cleaning fluid, in particular a modification of a temperature of the at least one cleaning fluid in at least one tank; a modification of washing mechanics of the cleaning appliance; a logging of the deviation of the jet behavior in at least one log; a transmission of an electronic message regarding the deviation of the jet behavior, in particular via at least one electronic interface and particularly preferably by means of e-mail and/or SMS.

Embodiment 20: the cleaning appliance according to any one of the preceding embodiments, wherein the cleaning appliance is selected from the group consisting of: a one-chamber dishwasher; a batch dishwasher; a pass-through dishwasher; a cleaning and disinfecting device for cleaning containers for receiving a human excretions.

Embodiment 21: the cleaning appliance according to any one of the preceding embodiments, wherein the cleaning appliance comprises a plurality of the nozzles.

Embodiment 22: the cleaning appliance according to the preceding embodiment, wherein the plurality of nozzles are arranged in a spray arm.

Embodiment 23: the cleaning appliance according to the preceding embodiment, wherein the spray arm is a rotatably mounted spray arm.

Embodiment 24: the cleaning appliance according to any one of the preceding embodiments, wherein the cleaning appliance comprises a plurality of the temperature sensors in the at least one desired jet region of the nozzle.

Embodiment 25: the cleaning appliance according to the preceding embodiment, wherein at least one of the nozzles is known to be susceptible to malfunction, wherein the temperature sensor is arranged in a desired jet region of the nozzle known to be susceptible to malfunction.

Embodiment 26: the cleaning appliance according to the preceding embodiment, wherein the nozzle known to be susceptible to malfunction comprises at least one nozzle at the end of a spray arm.

Embodiment 27: the cleaning appliance according to any one of the two preceding embodiments, wherein the nozzle known to be susceptible to malfunction is a nozzle for driving a spray arm.

Embodiment 28: a method for cleaning articles to be cleaned, wherein at least one cleaning appliance having at least one cleaning chamber and at least one nozzle for applying at least one cleaning fluid to the articles to be cleaned is used in the cleaning chamber, wherein at least one temperature sensor is also used, wherein the temperature sensor is arranged in at least one desired jet region of the nozzle, wherein the method comprises an analysis of at least one sensor signal of the temperature sensor and an evaluation of a jet behavior of the nozzle by means of the sensor signal.

Embodiment 29: the method according to the preceding embodiment, wherein the cleaning appliance is a cleaning appliance according to any one of the preceding embodiments relating to a cleaning appliance.

Embodiment 30: the method according to any one of the preceding embodiments relating to a method, wherein the method comprises at least a comparison of the sensor signal of the temperature sensor with at least one desired signal and at least an evaluation of the jet behavior of the nozzle on the basis of this comparison.

Embodiment 31: the method according to the preceding embodiment, wherein at least one comparison value is determined during the comparison, wherein the comparison value is compared with at least one threshold value and a measure for the jet behavior of the nozzle is determined from this comparison of the comparison value with the at least one threshold value.

Embodiment 32: the method according to any one of the preceding embodiments relating to a method, further comprising at least a comparison of the sensor signal of the temperature sensor with at least one temperature of the cleaning fluid.

Embodiment 33: the method according to the preceding embodiment, wherein the cleaning appliance contains at least one comparison temperature sensor for detecting the temperature of the cleaning fluid Embodiment 34: the method according to the preceding embodiment, wherein the comparison temperature sensor is arranged in at least one tank for receiving the cleaning fluid and/or in at least one line of the cleaning fluid.

Embodiment 35: the method according to any one of the three preceding embodiments, wherein at least one temperature difference is determined from the sensor signal, the temperature sensor, and the temperature of the cleaning fluid.

Embodiment 36: the method according to the preceding embodiment, wherein the temperature difference is compared with at least one threshold value.

Embodiment 37: the method according to the preceding embodiment, wherein a defective jet behavior of the nozzle is determined when the temperature difference or a value of the temperature difference reaches the threshold value or exceeds the threshold value.

Embodiment 38: the method according to any one of the two preceding embodiments, wherein the threshold value is selected from the group consisting of: a fixedly predefined threshold value; a threshold value predefined by a current cleaning program of the cleaning appliance; an adjustable threshold value; a threshold value that can be determined by means of at least one current operating parameter of the cleaning appliance.

Embodiment 39: the method according to any one of the preceding embodiments relating to a method, wherein the sensor signal is selected from the group consisting of: a current measured value of the at least one temperature sensor; a mean value of a plurality of measured values of the at least one temperature sensor, in particular a temporal mean value and particularly preferably an ongoing mean value; a filtered measured value of the at least one temperature sensor.

Embodiment 40: the method according to any one of the preceding embodiments relating to a method, wherein the method comprises a detection of a time curve of the jet behavior of the nozzle Embodiment 41: a method according to any one of the preceding embodiments relating to a method, wherein the cleaning appliance contains a plurality of the temperature sensors at different locations within the cleaning chamber, wherein the cleaning appliance is designed to detect a spatial profile of a temperature within the cleaning chamber.

Embodiment 42: the method according to the preceding embodiment, wherein a time curve of the spatial profile of the temperature is detected.

Embodiment 43: the method according to the preceding embodiment, wherein the time curve of the spatial profile of the temperature is stored in at least one data memory.

Embodiment 44: the method according to any one of the preceding embodiments relating to a method, wherein the method also comprises the execution of at least one predefined action when the jet behavior of the nozzle demonstrates a deviation from a predefined norm or a predefined normal range.

Embodiment 45: the method according to the preceding embodiment, wherein the action is selected from the group consisting of: an outputting of an error message; an outputting of a notification message; a stopping of a cleaning process; a stopping of a transport device of the cleaning appliance; a modification of a speed of a transport device of the cleaning appliance, in particular a reduction of the speed; a modification of a temperature of the at least one cleaning fluid, in particular a modification of a temperature of the at least one cleaning fluid in at least one tank; a modification of washing mechanics of the cleaning appliance; a logging of the deviation of the jet behavior in at least one log; a transmission of an electronic message regarding the deviation of the jet behavior, in particular via at least one electronic interface and particularly preferably by means of e-mail and/or SMS.

Embodiment 46: the method according to any one of the preceding embodiments relating to a method, wherein the cleaning appliance comprises a plurality of the nozzles.

Embodiment 47: the method according to the preceding embodiment, wherein the plurality of the nozzles are arranged in a spray arm.

Embodiment 48: the method according to the preceding embodiment, wherein the spray arm is a rotatably mounted spray arm.

Embodiment 49: the method according to any one of the preceding embodiments relating to a method, wherein the cleaning appliance comprises a plurality of the temperature sensors in the at least one desired jet region of the nozzle.

Embodiment 50: the method according to the preceding embodiment, wherein at least one of the nozzles is known to be susceptible to malfunction, wherein the temperature sensor is arranged in a desired jet region of the nozzle known to be susceptible to malfunction.

Embodiment 51: the method according to the preceding embodiment, wherein the nozzle known to be susceptible to malfunction comprises at least one nozzle at the end of a spray arm.

Embodiment 52: the method according to any one of the two preceding embodiments, wherein the nozzle known to be susceptible to malfunction is a nozzle for driving a spray arm.

Embodiment 53: use of at least one temperature sensor in a desired jet region of a nozzle of a cleaning appliance in order to evaluate a jet behavior of the nozzle.

BRIEF DESCRIPTION OF THE DRAWINGS

Further details and features of the invention will emerge from the following description of preferred exemplary embodiments, in particular in conjunction with the dependent claims. Here, the respective features can be implemented in isolation or in combination with one another. The invention is not limited to the exemplary embodiments. The exemplary embodiments are illustrated schematically in the drawings. Here, like reference numerals in the individual drawings denote like or functionally similar elements or elements that correspond to one another with regard to their functions.

More specifically.

DESCRIPTION OF EXEMPLARY EMBODIMENTS

Figure 1:
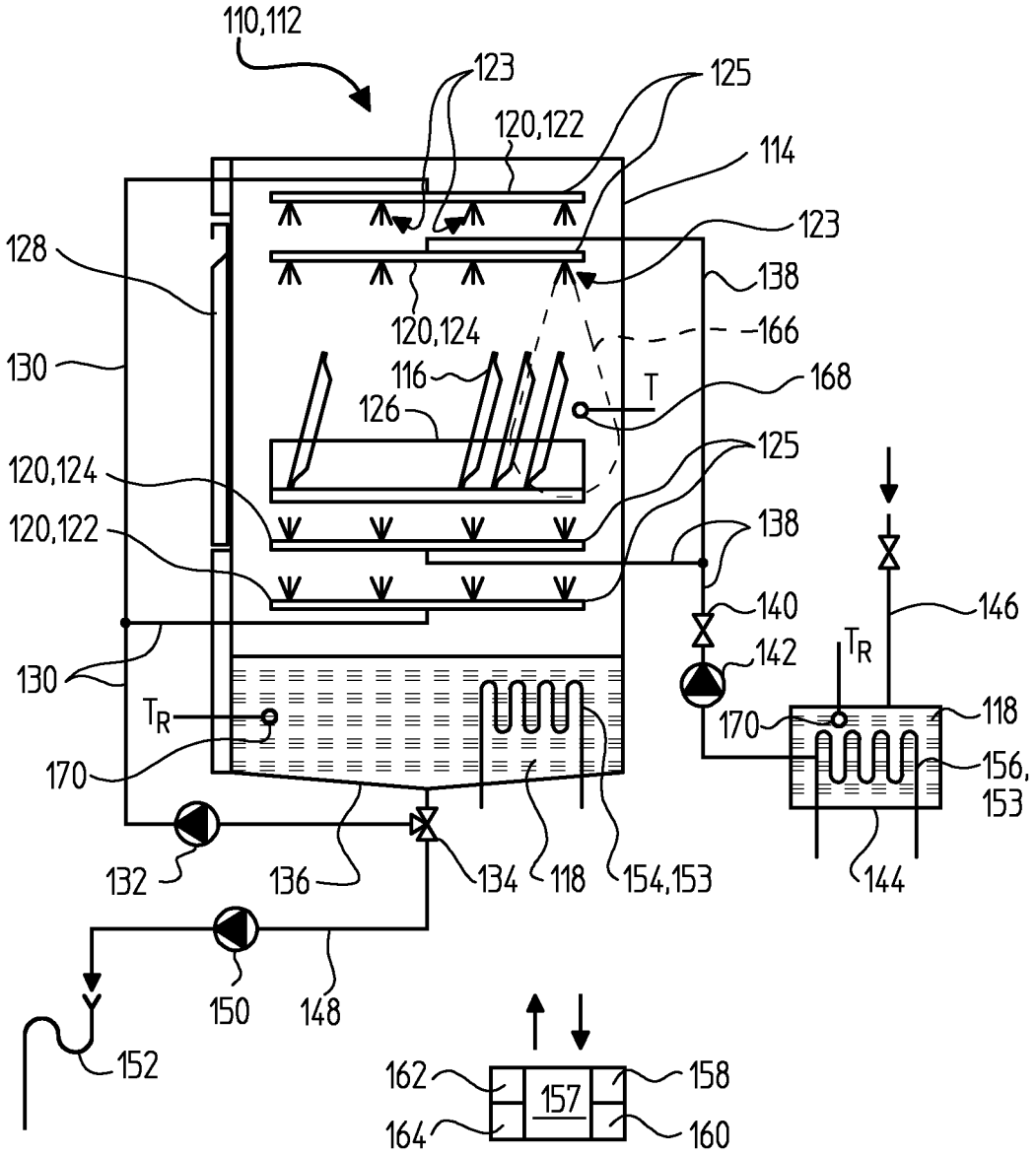
FIG. 1 shows a first exemplary embodiment of a cleaning appliance according to the invention in the form of a one-chamber dishwasher.

FIG. 1 shows a first exemplary embodiment of a cleaning appliance 110 according to the invention in a schematic sectional illustration. The cleaning appliance 110 is embodied in this case by way of example as a one-chamber dishwasher 112, in particular as a commercial one-chamber dishwasher. Reference can be made by way of example to DE 10 2008 015 796 B4 for examples of possible embodiments of one-chamber dishwashers 112 of this type. Other embodiments are also possible in principle.

The cleaning appliance 110 contains at least one cleaning chamber 114. Cleaning fluid 118 is applied to articles to be cleaned 116, for example crockery, in the cleaning chamber 114. One or more fluid devices 120, also referred to as application devices, can be provided for this application and in the illustrated exemplary embodiments can comprise by way of example a rinse nozzle system 122 and a secondary rinse nozzle system 124. The fluid device 120 comprises a plurality of nozzles 123, which for example can be arranged in spray arms 125 of the fluid device 120, for example in rotating spray arms 125. The nozzle systems 122, 124 can be arranged for example within the cleaning chamber 114 above and/or below a rack 126, in which the articles to be cleaned 116 are received. The cleaning chamber 114 can be loaded with the articles to be cleaned 116 for example via a door 128, for example a front hatch.

The rinse nozzle system 122 can be fed for example via rinse lines 130, a rinse pump 132 and via a 3-way valve 134 with cleaning fluid 118, for example a cleaning solution, from a rinse tank 136, which can be disposed for example in the base region of the cleaning chamber 114. The optional secondary rinse nozzle system 124 can be supplied for example via secondary rinse lines 138, a secondary rinse valve 140, and a secondary rinse pump 142 with cleaning fluid 118 from a secondary rinse tank 144, for example can be supplied with secondary rinse fluid in the form of a final rinse solution. The secondary rinse tank 144 can be supplied for example with fresh water via a fresh water feed line 146. The cleaning appliance 110 can also contain a drainage line 148, which for example can be connected to the rinse tank 136 via the 3-way valve 134, and which optionally can contain a drainage pump 150 and which optionally can be connected to an outflow 152.

The cleaning appliance 110 can also contain at least one temperature-control device 153 for controlling the temperature of the at least one cleaning fluid 118. By way of example, the cleaning appliance 110 can contain at least one heating element 154 for heating the cleaning fluid 118 in the rinse tank 136. The heating device 110 can also contain a further heating element 156 in the secondary rinse tank 144 for heating the cleaning fluid 118 received there in the form of the secondary rinse fluid. By way of example, the secondary rinse tank 144 can be formed as a boiler and/or can contain a flow-type heater or can be connected to a flow-type heater.

By way of example, at least one cleaning program can be performed in the cleaning appliance 110, which for example can be formed as a batch dishwasher. By way of example, at least one control unit 157 can be provided for this purpose, by means of which a program sequence can be controlled. In this cleaning program, a first program step for example can be carried out, in which the articles to be cleaned 116 are rinsed from the rinse tank 136.

This rinsing can be implemented for example in a recirculation mode via the rinse pump 132, which can also be referred to as a recirculation pump. The rinse fluid can then be discharged partially or fully from the rinse tank 136 via the drainage pump 150 and the 3-way valve 134. Parallel to the rinse step, a preparation of secondary rinse fluid, for example a heating of secondary rinse fluid, can already be performed in advance in the secondary rinse tank 144. In a further program step, after the rinse step, a secondary rinsing or final rinsing of the articles to be cleaned 116 with a cleaning fluid from the secondary rinse tank 144 can then be performed, wherein this can be performed in a single run or optionally likewise in a recirculation mode. One or more further program steps can follow, for example one or more drying steps, before the cleaning program can be completed.

The control unit 157 comprises for example at least one processor 158 and at least one data memory 160. The control unit 157 can also contain at least one user interface 162 and/or at least one data interface 164, for example for the wireless or wired exchange of data and/or control commands.

Depending on the program step, the nozzles 123 of the cleaning appliance 110 have a desired jet region, which is illustrated in FIG. 1 in a dashed manner for an exemplary nozzle and which is denoted by way of example by the reference numeral 166. This desired jet region 166 by way of example can be conical or fan-shaped or club-shaped. The desired jet region 166 can be different for each of the nozzles 123. These desired jet regions 166 of the individual nozzles 123 can be formed separately from one another, but can also overlap entirely or in part. Furthermore, the desired jet regions 166 of the individual nozzles 123 can change during a program sequence, since for example various nozzles 123 can be switched on or off during the above-described program and/or can be acted on by different pressures of the cleaning fluid 118. However, it is also possible in principle to determine, for example empirically, for a correctly functioning nozzle 123, the desired jet region 166 that this nozzle is associated with at the particular moment of operation.

In accordance with the invention the cleaning appliance 110 also comprises at least one temperature sensor 168 within the cleaning chamber 114. By way of example, this temperature sensor 168 can be associated with a specific nozzle 123, as is shown by way of example in FIG. 1 on the basis of the outermost right nozzle of the upper spray arm of the secondary rinse nozzle system 124. The temperature sensor 168 is particularly preferably arranged in a desired jet region 166 of a nozzle 123 which, as is known in general or from experience, tends particularly towards becoming constricted, blocked or demonstrating other deviations from a normal behavior. As discussed above, this can be the case in particular for the outer nozzles 123 in one or more spray arms 125, in particular in rotatably mounted spray arms.

The at least one temperature sensor 168 generates at least one sensor signal, which can be transmitted for example to the control unit 157. The control unit 157 is designed to analyze the sensor signal and to evaluate a jet behavior of the nozzle on the basis of the sensor signal.

By way of example, at least one comparison value, i.e. at least one threshold value, can be predefined in the control unit 157 for this purpose, for example can be stored in the data memory 160, with which value the sensor signal can be compared directly or following processing. Alternatively or additionally, the cleaning appliance 110 can contain at least one comparison temperature sensor 170, which is designed to detect a temperature of the cleaning fluid 118. By way of example, at least one comparison temperature sensor 170 can be arranged in at least one tank of the cleaning fluid 118, for example, as shown by way of example in FIG. 1, in the rinse tank 136 and/or in the secondary rinse tank 144. The one or more comparison temperature sensors 170 can be designed to transmit at least one comparison temperature signal directly or indirectly to the control unit 157. The control unit 157 can be designed accordingly to determine at least one temperature difference from the temperature signal of the temperature sensor 168 and the temperature of the cleaning fluid 118 determined by means of the comparison temperature sensor 170. By way of example, the control unit 157 can also be designed to check whether the temperature difference lies in a normal range, for example by comparing the temperature difference with at least one threshold value. By way of example, as discussed above, it is thus possible to determine a defective jet behavior of the nozzle 123 when the temperature difference or a value of the temperature difference reaches the threshold value or exceeds the threshold value. Furthermore, a plurality of temperature sensors 168 can be provided within the cleaning chamber 114, by means of which temperature sensors a temperature profile within the cleaning chamber 114 can be created.

Figure 2:
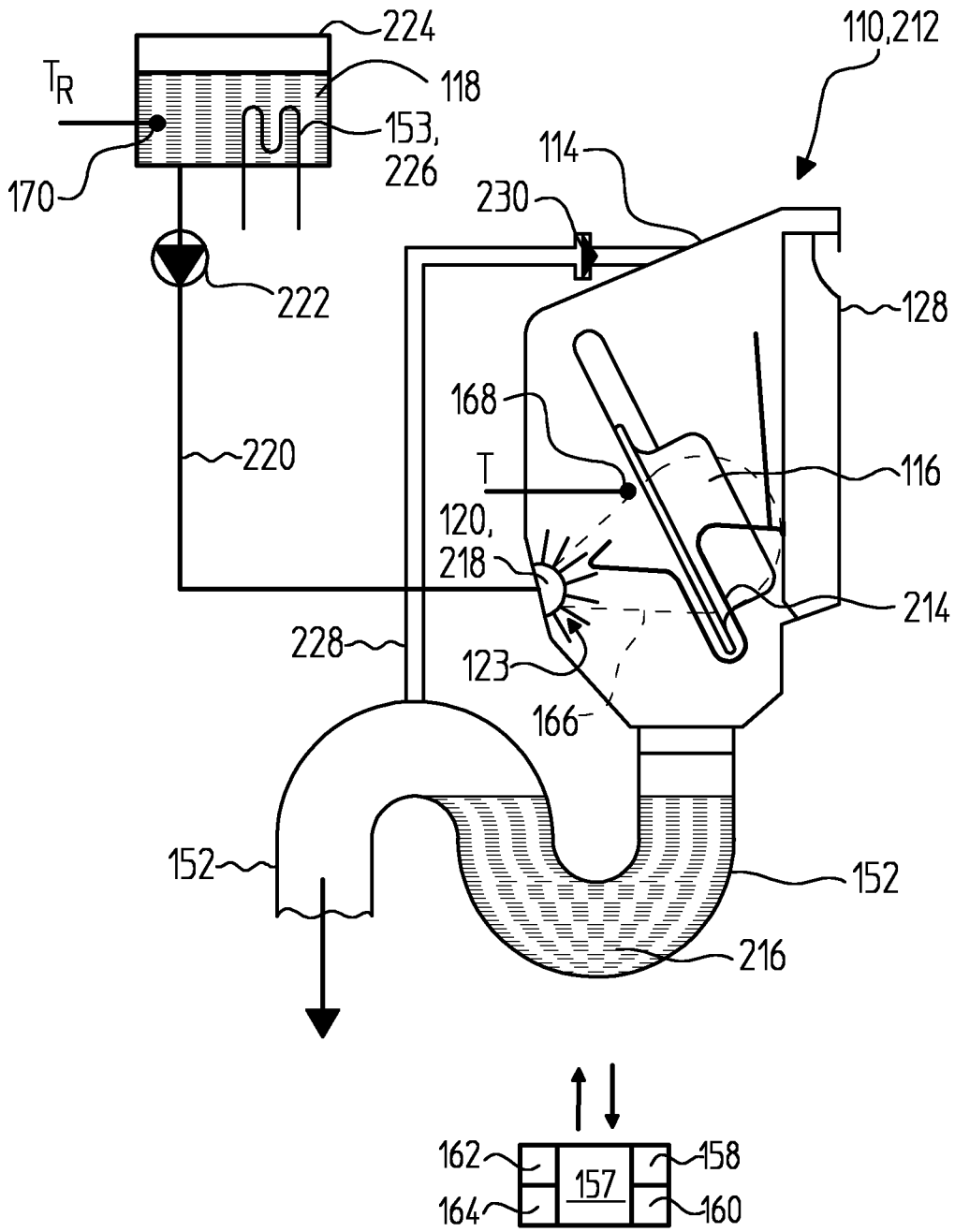
FIG. 2 shows a second exemplary embodiment of a cleaning appliance according to the invention in the form of a cleaning and disinfecting device.

In FIG. 2 a further exemplary embodiment of a cleaning appliance 110 according to the invention is shown, likewise in a sectional illustration similarly to FIG. 1. In this exemplary embodiment the cleaning appliance 110 is formed as a cleaning and disinfecting device 212. The cleaning appliance 110 again comprises a cleaning chamber 114 having a door 128, for example a front hatch. Articles to be cleaned 116, for example in the form of one or more vessels or containers for receiving large quantities of human or animal excretions, can be received in the cleaning chamber 114. By way of example, these containers can have a receiving volume of at least 100 ml, preferably of at least 200 ml, or at least 300 ml. The articles to be cleaned 116 can be held for example in an appropriate mount 214. This mount 214 is preferably formed in such a way that as the door 128 is closed the articles to be cleaned 116 are automatically emptied into an outflow 152, which in particular can comprise a siphon bend or another type of odor block or odor trap.

Cleaning fluid 118 can be applied to the articles to be cleaned 116 in the cleaning chamber 114. For this purpose, a fluid device 120 in the form of a nozzle system 218 can again be provided. The nozzle system 218 comprises one or more nozzles 123. Just one nozzle 123 is shown by way of example in FIG. 2, however a plurality of nozzles 123 can also be provided, for example at different locations within the cleaning chamber 114. The at least one nozzle 123 again has, similarly to the illustration of the exemplary embodiment according to FIG. 1, a desired jet region 166 denoted by way of example by the reference numeral 166. The nozzle system 218 can be fed for example via a line system 220 and optionally a pump 222 from one or more tanks 224. Here, different types of cleaning fluids 118 can also be used in succession. By way of example, cold, aqueous cleaning fluid can first be applied, for example following the emptying into the outflow 152, and heated, and aqueous cleaning fluid can then be applied in a further step, optionally with addition of one or more cleaning agents and/or one or more disinfectants. Hot steam can then optionally be applied, for which purpose the cleaning appliance 110 can comprise a steam generator (not illustrated in FIG. 2), for example. The different cleaning fluids 118 can be applied via the same fluid system 120 and/or also via different fluid systems. In order to generate heated cleaning fluid 118 and/or in order to generate hot steam, one or more temperature-control devices 153 can again be provided, for example one or more heating elements 226.

Once the cleaning fluid 118 has been applied to the articles to be cleaned 116, a drying phase can follow. During this drying phase, fresh air and/or also hot air for example can be introduced into the cleaning chamber 114, for example forcibly via a fan (not illustrated in FIG. 2). With this forced introduction of fresh air and/or heated air, the moist air present in the cleaning chamber 114 and/or the moist steam present in the cleaning chamber can be displaced via a bypass 228, optionally by means of at least one check valve 230, into the outflow 152, bypassing the odor trap or the siphon bend 216. In this way, it can be ensured that no moist air and no hot steam can pass into the ambient environment when the door 128 is opened.

Similarly to the embodiment of the cleaning appliance 110 according to FIG. 1, the cleaning appliance 110 in the present case as well again contains at least one temperature sensor 168, which is arranged in the desired jet region 166 of the at least one nozzle. By way of example, at least one sensor signal can again be generated, which is transmitted to at least one control unit 157 of the cleaning and disinfecting device 212. The control unit 157 can again be formed similarly to the above control unit 157 of the cleaning appliance 110 according to FIG. 1, for example. It can again be designed to evaluate a jet behavior of the at least one nozzle 123 on account of a sensor signal of the temperature sensor 168. This can again be implemented for example by comparison with at least one normal value and/or at least one threshold value, and/or by establishing a difference. At least one comparison temperature sensor 170 can again be provided, for example in the tank 224, in order to determine at least one temperature of the cleaning fluid 118. At least one temperature difference can be determined from the sensor signal of the temperature sensor 168 and the temperature of the cleaning fluid, which for example can be derived directly or indirectly from a sensor signal of the comparison temperature sensor 170. The one or more temperature differences can then again be examined for example in order to ascertain whether this temperature difference or these temperature differences lies/lie in a normal range, for example by means of a comparison with at least one threshold value. By way of example, it can be ensured in this way that the actual jet region of the at least one nozzle 123 matches the desired object region to such an extent that a hygienization effect is ensured.

Figure 3A:
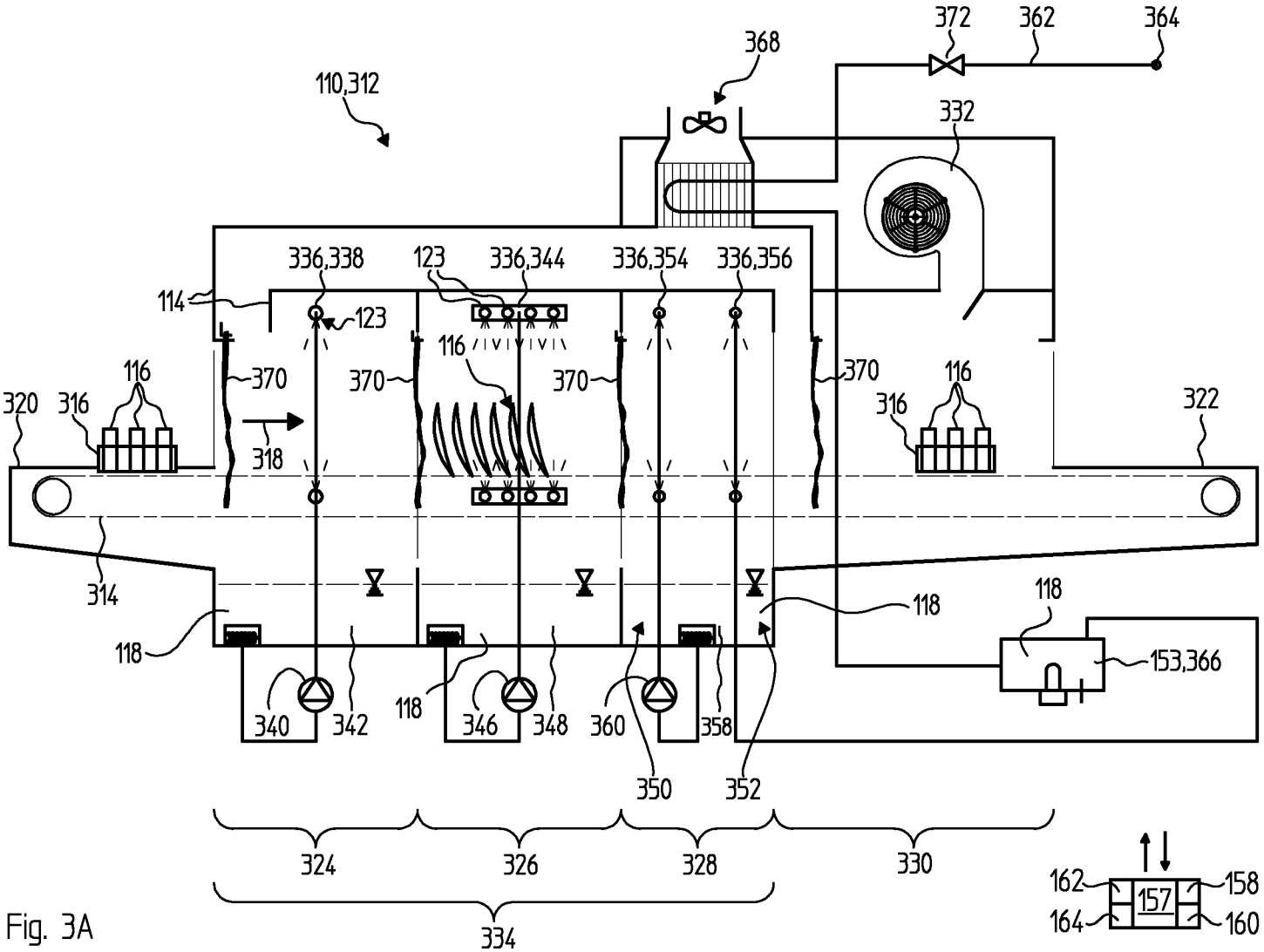
FIGS. 3A and 3B show two different sectional illustrations of a third embodiment of a cleaning appliance according to the invention in the form of a pass-through dishwasher.
Figure 3B:
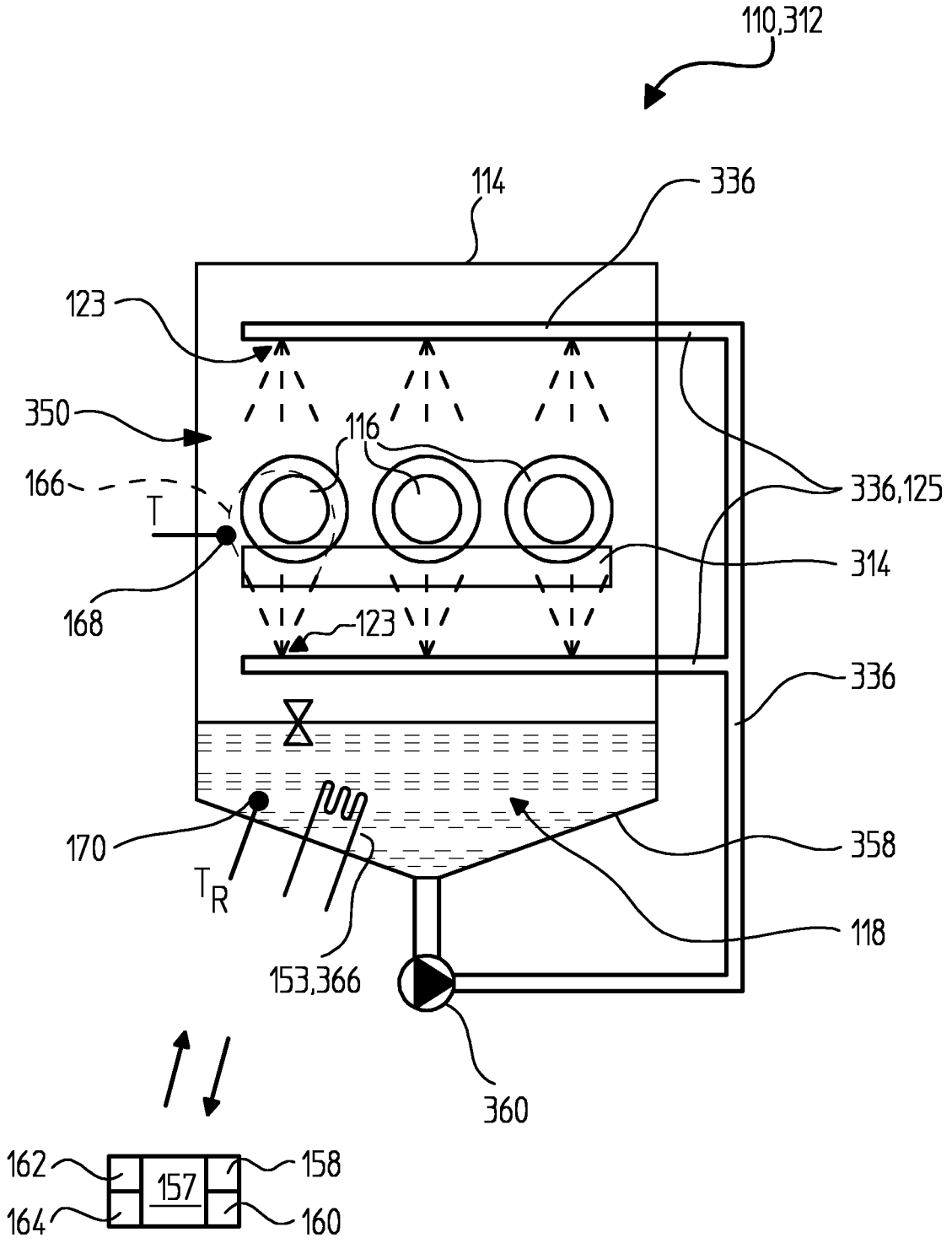

FIGS. 3A and 3B illustrate a further exemplary embodiment of a cleaning appliance 110 according to the invention. The cleaning appliance 110 is formed in this exemplary embodiment as a pass-through dishwasher 312 and has a transport device 314, by means of which articles to be cleaned 116, for example crockery, can be transported through a cleaning chamber 114 of the cleaning appliance 110. By way of example, the cleaning appliance 110 can be formed as a rack conveyor dishwasher and can be designed to transport the articles to be cleaned 116 in transport racks 316, or can be formed as a flight-type dishwasher, in which the articles to be cleaned 116 are transported directly on a conveyor belt, as shown in this exemplary embodiment.

The articles to be cleaned 116 can be transported by means of the transport device 314 in a transport direction 318 from an entry zone 320 to a discharge zone 322. The cleaning chamber 114 can be divided here into a plurality of zones, wherein for example a pre-removal zone 324, a wash zone 326, and a final rinse zone 328 can be provided. These zones can then also be followed by at least one drying zone 330, in which the articles to be cleaned 116 are dried by means of a fan 332.

Zones 324, 326 and 328 can be referred to generally as rinse zones 334, within which application devices 336 in the form of nozzle systems comprising nozzles 123 are provided in order to apply at least one cleaning fluid 118 to the articles to be cleaned 116.

A pre-removal nozzle system 338 can thus be provided in the pre-removal zone 324, which pre-removal nozzle system is fed via a pre-removal pump 340 from a pre-removal tank 342. A wash zone nozzle system 344 can be provided in the wash zone 326, which wash zone nozzle system can be fed via a wash zone pump 346 from a wash tank 348. The final rinse zone 328 can contain a pump final rinse section 350 and a fresh water final rinse section 352, which follows in the transport direction 318. The pump final rinse section 350 has a pump final rinse nozzle system 354, and the fresh water final rinse section 352 has a fresh water final rinse nozzle system 356. Whereas the pump final rinse section nozzle system 354 is fed from a final rinse tank 358 via a final rinse pump 360, the fresh water final rinse section nozzle system 356 is fed via a fresh water feed line 362 with fresh water from a fresh water connection point 364 in a building. The fresh water feed line 362 can comprise for example a temperature-control device 153 in the form of a heating device 366, by means of which the fed fresh water can be heated, for example to a temperature from 80° C. to 100° C., preferably to a temperature of at least 85° C. The fresh water feed line 362 can be guided optionally via at least one heat recovery device 368, in which waste heat of the cleaning appliance 110 can be used in order to heat fed fresh water.

The articles to be cleaned 116 can be guided continuously or discontinuously through the rinse zones 334 by means of the transport device 314 before the articles to be cleaned 116 are dried in the drying zone 330. The rinse zones 334 can each be terminated by separation curtains 370.

The cleaning appliance 110 preferably uses a number of types of cleaning fluid 118 in the form of rinse fluids, which are preferably all aqueous rinse fluids. Fresh water is thus preferably used in the fresh water rinse section 352 as rinse fluid, optionally with added final rinse aid. In the fresh water final rinse section 352, the rinse fluid comes into contact just once with the articles to be cleaned 116. By contrast, in the pump final rinse section 350, final rinse liquid from the final rinse tank 358 is applied to the articles to be cleaned 116 in a recirculation mode. In the wash tank 348 the rinse liquid can be mixed for example with the cleaning agent, for example cleaning solution. In the wash zone 326 the articles to be cleaned 116 can be cleaned in a recirculation mode using the rinse liquid from the wash tank 348. The articles to be cleaned 116 can be acted on in the pre-removal zone 324 in the recirculation mode.

As discussed above, the cleaning fluid 118 in the form of the rinse liquids can be mixed in the tanks 342, 348 and 358 with one or more detergent substances. For this purpose, one or more metering devices can be provided, which are not indicated in FIG. 3A or FIG. 3B. For example, a metering device can optionally be provided at the fresh water feed line 362, by means of which metering device a final rinse agent and/or a disinfectant can be fed to the fresh water final rinse section 352. The connection of the at least one metering point can be before and/or after the heating device, for example. Alternatively or additionally, a metering device can be provided at the final rinse tank 358, by means of which a final rinse agent and/or a disinfectant can be metered into the final rinse tank 358. By way of example, at least one metering device can optionally be provided in the wash zone 326, by means of which metering device one or more cleaning agents can be metered into the wash tank 348. Alternatively or additionally, at least one metering device can be provided in the pre-removal zone 324, by means of which metering device(s) at least one cleaning agent can be metered into the pre-removal tank 342. The metering device(s) can be provided individually, in pairs or in specified combinations. A different arrangement, combination and type of metering are also possible, however, in principle.

The cleaning appliance 110 in the illustrated arrangement also again can contain at least one control unit 157, which for example can be formed similarly to the control units in FIGS. 1 and 2. Here, the control unit may be for example a central machine control unit, which can also be formed in a decentralized manner, however, in principle. By way of example, one or more cleaning programs can be controlled in the cleaning appliance 110 by means of the at least one control unit 157. The control unit 157 can be connected in particular to at least one feed valve 372, which can control a fresh water feed, and/or can be connected to one or more of the specified metering devices in order to control these elements. The control unit 157 for example can also be connected wholly or partially to the pumps 340, 346 and 360, and can control these pumps. Furthermore, the control unit 157 can be connected for example to the at least one transport appliance 314, and can control the transport appliance 314. The control unit 157 can be formed for example wholly or partially as a regulation device and/or can comprise at least one regulation.

The cleaning appliance 110 can again contain one or more sensors for detecting one or more operating parameters, similarly to the cleaning appliances 110 in the exemplary embodiments according to FIGS. 1 and 2. The cleaning appliance 110 can thus contain, for example, one or more sensors for detecting a feed and/or a concentration of one or more components of the rinse liquid. The sensors can be generally connected directly or indirectly to the at least one control unit 157. The cleaning appliance 110 can thus contain, for example, at least one flowmeter for detecting a volumetric flow and/or mass flow of a feed of fresh water. Alternatively or additionally, the cleaning appliance 110 can also contain one or more sensors in the tanks 342, 348 and 358. By way of example, turbidity sensors and/or conductivity sensors can be provided there, by means of which for example a cleaning agent concentration and/or a degree of soiling can be detected. In order to carry out the regulation of a feed of one or more components of the one or more rinse liquids of the cleaning appliance 110, for example in order to regulate a fresh water feed and/or in order to regulate a metering of cleaning agent, the control unit 157 can comprise for example one or more regulators, which for example can be implemented in the form of a software and/or in the form of a hardware. These can detect one or more actual values, for example by means of the sensors and/or by means of a flowmeter, and can regulate a feed to at least one desired value, for example by means of the specified metering devices and/or the feed valve 372.

FIG. 3A shows a sectional illustration of the cleaning appliance 110 parallel to the transport direction 318. In FIG. 3B a sectional illustration perpendicular to the transport direction 318 is shown by way of example, for example a sectional illustration perpendicular to the transport direction 318 through the pump final rinse section 350. Similarly, however, sectional illustrations at other locations within the pass-through dishwasher 312 could also be shown in principle, for example through the pre-removal zone 324, the wash zone 326 or through the final rinse zone 328 in the region of the fresh water final rinse section 352.

The illustration according to FIG. 3B shows that for example at least one temperature-control device 153, for example in the form of a heating device 366, can again be arranged within the tank, in this case the final rinse tank 358. The illustration according to FIG. 3B also shows that the application device 336 of the pump final rinse section 350 can again contain spray arms 125, for example above and below the transport device 314, which spray arms can each have one or more nozzles 123. These nozzles again each have a desired jet region 166, which is illustrated in FIG. 3B by way of example for the outermost nozzle 123 of the lower spray arm 125. At least one temperature sensor 168, which for example can again be directly or indirectly connected to the control unit 157 and/or can directly or indirectly or in another way transmit at least one sensor signal to the control unit 157, is again provided by way of example in this desired jet region 166 of this nozzle 123. The control unit 157 is designed to analyze this sensor signal of the at least one temperature sensor 168 and to evaluate a jet behavior of this at least one nozzle 123 on the basis of this sensor signal. For this purpose, a comparison with at least one threshold value and/or with at least one normal range can be performed, as also in the other exemplary embodiments. Alternatively or additionally, as is also the case in the other exemplary embodiments, at least one comparison temperature sensor 170 in a tank of the cleaning fluid 118, for example in the final rinse tank 358, can be used again as reference. Accordingly, at least one temperature difference can again be determined from the sensor signals of the temperature sensor 168 and the comparison temperature sensor 170, and it can be checked whether the temperature difference or the value thereof lies within a predefined or predefinable normal range, such that it can be determined whether or not the jet behavior of the nozzle 123 lies in a normal range.

It should be noted that the arrangements illustrated in the described exemplary embodiments are to be understood merely by way of example. For example, the at least one temperature sensor 168, alternatively or additionally to the embodiment illustrated in FIG. 3B, can also be mounted at different locations within the cleaning chamber 114. Alternatively or additionally to the nozzle shown in FIG. 3B, desired jet regions 166 of one or more other nozzles of the application device or of the application devices 336 of the cleaning appliance 110 can thus be monitored. As discussed above, it is particularly preferable however in this or other exemplary embodiments if, by way of example, one or more nozzles 123 that is/are known to be critical insofar as this nozzle/these nozzles often tends/tend towards becoming constricted, blocked or demonstrating other deviations from a normal jet behavior is/are monitored. By way of example, as discussed above, these critical nozzles 123 can be nozzles at the end of one or more pipes, for example at the end of the spray arms 125.

If a deviation of a jet behavior of the at least one monitored nozzle 123 from a normal value or a normal behavior is determined, one or more of the specified actions can be executed, as discussed above, by the control unit 157, preferably automatically. By way of example, as discussed above, a warning can be output to a user. Alternatively or additionally, the operation of the cleaning appliance 110 can be stopped, and/or a transport speed of the transport device 314 can be changed. If, for example, it is determined that the jet behavior of the at least one nozzle 123 deviates from the normal behavior, yet a wetting with cleaning fluid 118 still takes place here in principle, a transport speed can be reduced for example, in order to ensure a sufficient cleaning and/or hygienization of the articles to be cleaned 116, at least in a time-based integration. Other actions are also conceivable.

LIST OF REFERENCE SIGNS

110 cleaning appliance
112 one-chamber dishwasher
114 cleaning chamber
116 articles to be cleaned
118 cleaning fluid
120 fluid device
122 rinse nozzle system
123 nozzles
124 secondary rinse nozzle system
125 spray arms
126 rack
128 door
130 rinse line
132 rinse pump
134 3-way valve
136 rinse tank
138 secondary rinse line
140 secondary rinse valve
142 secondary rinse pump
144 secondary rinse tank
146 fresh water feed line
148 drainage line
150 drainage pump
152 outflow
153 temperature-control device
154 heating element
156 further heating element
157 control unit
158 processor
160 data memory
162 user interface
164 data interface
166 desired jet region
168 temperature sensor
170 comparison temperature sensor
212 cleaning and disinfecting device
214 mount
216 siphon bend
218 nozzle system
220 line system
222 pump
224 tank
226 heating element
228 bypass
230 check valve
312 pass-through dishwasher
314 transport device
316 transport rack
318 transport direction
320 entry zone
322 discharge zone
324 pre-removal zone
326 wash zone
328 final rinse zone
330 drying zone
332 fan
334 rinse zone
336 application device
338 pre-removal nozzle system
340 pre-removal pump
342 pre-removal tank
344 wash zone nozzle system
346 wash zone pump
348 wash tank
350 pump final rinse section
352 fresh water final rinse section
354 pump final rinse section nozzle system
356 fresh water rinse section nozzle system
358 final rinse tank
360 final rinse pump
362 fresh water feed line
364 fresh water connection point
366 heating device
368 heat recovery device
370 separation curtains
372 feed valve

The invention claimed is:

1. A cleaning appliance for cleaning articles to be cleaned, said cleaning appliance comprising at least one cleaning chamber and at least one nozzle for applying at least one cleaning fluid to the articles to be cleaned within the cleaning chamber, and said cleaning appliance further comprising at least one temperature sensor, wherein the temperature sensor is arranged in at least one desired jet region of the nozzle, and said cleaning appliance further comprising a control unit, wherein the control unit is programmed to analyze at least one sensor signal of the temperature sensor and to evaluate a jet behavior of the nozzle on the basis of the sensor signal, wherein the cleaning appliance has at least one comparison temperature sensor for detecting at least one temperature of the cleaning fluid, wherein the evaluation of the jet behavior includes comparing the sensor signal of the temperature sensor with the at least one temperature of the cleaning fluid, wherein the cleaning appliance has a plurality of the temperature sensors at different locations within the cleaning chamber, and wherein the control unit is programmed to detect a spatial profile of a temperature within the cleaning chamber, and wherein the cleaning appliance comprises a plurality of nozzles and the plurality of temperature sensors, and wherein the plurality of temperature sensors are arranged in each desired jet region of each of the nozzles, or wherein the plurality of temperature sensors are arranged in one desired jet region of one of the nozzles.

2. The cleaning appliance as claimed in claim 1 wherein the cleaning appliance has at least one temperature-control device for heating the cleaning fluid.

3. The cleaning appliance as claimed in claim 1, wherein the control unit is programmed to compare the sensor signal of the temperature sensor with at least one desired signal and to evaluate the jet behavior of the nozzle on the basis of this comparison.

4. The cleaning appliance as claimed in claim 3, wherein the control unit is programmed in such a way that during the comparison a comparison value is determined, wherein the comparison value is compared with at least one threshold value and a measure for the jet behavior of the nozzle is determined from this comparison of the comparison value with the at least one threshold value.

5. The cleaning appliance as claimed in claim 4, wherein the cleaning appliance has at least one comparison temperature sensor for detecting at least one temperature of the cleaning fluid and the control unit is programmed to determine at least one temperature difference from the sensor signal of the temperature sensor and at least one temperature of the cleaning fluid.

6. The cleaning appliance as claimed in claim 5, wherein the control unit is programmed to compare the temperature difference with the at least one threshold value.

7. The cleaning appliance as claimed in claim 6, wherein the control unit is programmed to determine that the jet behavior of the nozzle is defective when the temperature difference or a value of the temperature difference reaches the threshold value or exceeds the threshold value.

8. The cleaning appliance as claimed in claim 1, wherein the control unit is programmed to detect a time curve of the jet behavior of the nozzle.

9. The cleaning appliance as claimed in claim 1, wherein the control unit is programmed to carry out at least one predefined action when the jet behavior of the nozzle demonstrates a deviation from a predefined norm or a predefined normal range.

10. The cleaning appliance as claimed in claim 9, wherein the action is selected from the group consisting of: an output of an error message; an output of a notification message; a stopping of a cleaning process; a stopping of a transport device of the cleaning appliance; a modification of a speed of a transport device of the cleaning appliance; a modification of a temperature of the at least one cleaning fluid; a modification of washing mechanics of the cleaning appliance; a logging of the deviation of the jet behavior in at least one log; and a transmission of an electronic message regarding the deviation of the jet behavior.

11. The cleaning appliance as claimed in claim 10, wherein the modification of the speed of the transport device of the cleaning appliance is a reduction of the speed.

12. The cleaning appliance as claimed in claim 10, wherein the modification of the temperature of the at least one cleaning fluid is a modification of a temperature of the at least one cleaning fluid in at least one tank.

13. The cleaning appliance as claimed in claim 10, wherein the transmission of the electronic message regarding the deviation of the jet behavior is configured to be conducted via at least one electronic interface.

14. The cleaning appliance as claimed in claim 13, wherein the transmission of the electronic message regarding the deviation of the jet behavior is configured to be conducted by means of at least one of e-mail or SMS.

15. The cleaning appliance as claimed in claim 14, wherein the nozzles are arranged completely or in part in a spray arm, and wherein the spray arm is a rotatably mounted spray arm.

16. The cleaning appliance as claimed in claim 14, wherein the desired jet regions of the nozzles are formed separately from one another.

17. The cleaning appliance as claimed in claim 1, wherein the control unit is programmed to detect a time curve of the jet behavior of the at least one nozzle and to determine when the jet behavior of the at least one nozzle changes with the scope of operation of the cleaning appliance.

18. The cleaning appliance as claimed in claim 1, wherein the control unit comprises at least one processor and at least one data memory, wherein the control unit contains at least one user interface and/or at least one data interface.

* * * * *